US005580691A

United States Patent [19]

Funato et al.

[11] Patent Number: 5,580,691

[45] Date of Patent: Dec. 3, 1996

[54] TONER FOR A TWO-COMPONENT TYPE DEVELOPER

[75] Inventors: Masatomi Funato; Yoshitake Shimizu; Seijiro Ishimaru; Norio Kubo; Kazuya Nagao; Terumichi Asano, all of Osaka, Japan

[73] Assignee: Mita Industrial Co., Ltd., Osaka, Japan

[21] Appl. No.: 364,769

[22] Filed: Dec. 27, 1994

[30] Foreign Application Priority Data

| | | | |
|---|---|---|---|
| Aug. 31, 1994 | [JP] | Japan | 6-207408 |
| Aug. 31, 1994 | [JP] | Japan | 6-207409 |
| Aug. 31, 1994 | [JP] | Japan | 6-207410 |
| Aug. 31, 1994 | [JP] | Japan | 6-207411 |

[51] Int. Cl.[6] ..... G03G 9/083

[52] U.S. Cl. ..... 430/106.6; 430/169; 430/904

[58] Field of Search ..... 430/110, 109, 430/106.6

[56] References Cited

U.S. PATENT DOCUMENTS

| | | | |
|---|---|---|---|
| 4,246,332 | 1/1981 | Tanaka et al. | 430/110 |
| 4,837,391 | 6/1989 | Anderson et al. | 430/110 |
| 4,837,393 | 6/1989 | Alexandrovich et al. | 430/110 |
| 4,882,258 | 11/1989 | Ikeuchi et al. | 430/108 |
| 4,925,765 | 5/1990 | Madeleine | 430/110 |
| 5,364,721 | 11/1994 | Asada et al. | 430/109 |

FOREIGN PATENT DOCUMENTS

| | | |
|---|---|---|
| 0357042 | 3/1990 | European Pat. Off. . |
| 0407604 | 1/1991 | European Pat. Off. . |
| 3806595 | 9/1988 | Germany . |
| 56-106249 | 8/1981 | Japan . |
| 59-162563 | 9/1984 | Japan . |
| 60-4950 | 1/1985 | Japan . |
| 367268 | 3/1991 | Japan . |

OTHER PUBLICATIONS

Diamond, Arthur, editor, *Handbook of Imaging Materials*, New York: Marcel–Dekker, Inc 1991, pp. 170–176.

Search Report for European Appl. 95305608.2, mailed Feb. 9, 1996.

*Primary Examiner*—Christopher D. Rodee

*Attorney, Agent, or Firm*—Renner, Otto, Boisselle & Sklar, P.L.L.

[57] ABSTRACT

The invention provides toner for a two-component type developer containing toner particles including a binder resin and magnetic powder dispersed in the binder resin. The binder resin in the toner is made of a composition including a low molecular weight polymer and a high molecular weight polymer both having an anionic group. The magnetic powder is contained in the toner particles in the range of 0.1 to 5 parts by weight per 100 parts by weight of the binder resin.

8 Claims, 4 Drawing Sheets

TONER FOR A TWO-COMPONENT TYPE DEVELOPER

BACKGROUND OF THE INVENTION

1. Field of the Invention

The present invention relates to toner for a two-component type developer used for electrophotography. More particularly, the present invention relates to toner, which does not include a charge control agent, suitably used in an electrophotographic image forming apparatus such as an electrostatic copying machine and a laser beam printer.

2. Description of the Related Art

A two-component type developer is used as one of the developers used for developing an electrostatic latent image on a photosensitive body in an electrophotographic image forming apparatus. The two-component type developer includes toner comprising a binder resin and a coloring agent such as carbon black, and magnetic carrier such as iron powder and ferrite particles.

An electrostatic latent image is developed by the following steps: the developer forms a magnetic brush shape on a developing roller by a magnetic field thereof and is carried out to the photosensitive body. In this step, the toner is charged by friction with the carrier so as to have a desired charge and polarity of charge. Then, the developer is contacted with the photosensitive body by the developing roller, resulting in attaching the toner onto the electrostatic latent image formed thereon. Generally, the toner includes a charge control agent which controls and stabilizes the charge of the toner so as to attach a constant amount of the toner on the electrostatic latent image and provide a good developed image for a long period of time. Negatively charged toner includes a negative charge control agent such as a dye of a metal complex including a metal ion such as chrome(III) (for example, an azo compound—chrome(III) complex), and an oxycarboxylic acid—metal complex (for example, a salicylic acid—metal complex) (Japanese Laid-Open Patent Publication No. 3-67268). Positively charged toner includes a positive charge control agent such as an oil soluble dye including nigrosine and an amine type charge control agent (Japanese Laid-Open Patent Publication No. 56-106249).

Many metal complexes, including a heavy metal ion such as a chrome ion, are used as a conventional charge control agent. They are carefully selected, in terms of environmental safety, so that only those having passed various toxicity tests and safety tests alone are used. Therefore, although they would be safe in themselves or when included in toner, it is more preferable to refrain from using the metal complexes including a heavy metal as the charge control agent. In addition, the charge control agent is expensive as compared with the other materials for toner such as a binder resin and a coloring agent, for example, carbon black. Therefore, although the charge control agent has a content of merely several %, this results in increasing the price of the resultant toner. Accordingly, it is desired to develop toner having no charge control agent of a metal complex.

Furthermore, when conventional toner is used for a long period of time, the toner components tend to attach on a surface of the carrier particle. The attached components are called a spent. The spent makes the carrier charge with the same polarity as the toner, resulting in the disadvantages that the toner can be scattered and transfer efficiency of toner image is decreased.

SUMMARY OF THE INVENTION

The toner for a two-component type developer of this invention comprises toner particles including a binder resin and magnetic powder dispersed in the binder resin. The binder resin is made of a composition containing a resin including a low molecular weight polymer and a high molecular weight polymer, and both the polymers have an anionic group. The magnetic powder is contained in the toner particles in the range of 0.1 to 5 parts by weight per 100 parts by weight of the binder resin.

In one embodiment, the polymer with a lower molecular weight has a smaller acid value than the high molecular weight polymer.

In one embodiment, the low molecular weight polymer has an acid value of 3 through 15, the high molecular weight polymer has an acid value of 6 through 25, and a ratio of the acid value of the low molecular weight polymer to that of the high molecular weight polymer is in the range from 1:1.2 to 1:8.

In one embodiment, the low molecular weight polymer includes a styrene component at a proportion of 70% or less.

In one embodiment, a content of the anionic group in the low molecular weight polymer is smaller than that in the high molecular weight polymer, and the low molecular weight polymer has a smaller SP value than that of the high molecular weight polymer.

In one embodiment, the resin made of the low molecular weight polymer and the high molecular weight polymer is a styrene-acrylic polymer, and the styrene-acrylic polymer has the following chemical properties:

(a) a peak of a molecular weight of the styrene-acrylic polymer is in the range between 4,000 and 30,000;

(b) a weight-average molecular weight of the styrene-acrylic polymer is in the range between 70,000 and 200,000; and (c) an acid value of the styrene-acrylic polymer is in the range between 4 and 20.

In one embodiment, an extracted solution obtained by extracting the toner with methanol has substantially no absorption peak in the range of 280 to 350 nm, and has an absorbance of substantially zero in the rang of 400 to 700 nm.

In one embodiment the magnetic powder is contained in the range of 0.5 to 3 parts by weight per 100 parts by weight of the binder resin.

In one embodiment, the toner particles have a volume-based average particle diameter of 5 through 15 μm, and spacer particles with a volume-based average particle diameter of 0.05 through 1.0 μm are attached onto the surfaces of the toner particles.

Thus, the invention described herein makes possible the advantages of (1) providing toner with excellent chargeability including no charge control agent at all; (2) providing toner little scattered in development for realizing a copied image with a high quality; and (3) providing toner in which a spent is not caused even when used for a long period of time, and hence, by which an excellent image quality can be maintained and transfer efficiency can be stabilized.

These and other advantages of the present invention will become apparent to those skilled in the art upon reading and understanding the following detailed description with reference to the accompanying figures.

DESCRIPTION OF THE PREFERRED EMBODIMENTS

Toner for a two-component type developer according to the present invention has no charge control agent, such as a dye of an azo compound—metal complex and an oxycarboxylic acid—metal complex, at all. Therefore, a spent caused by a charge control agent, which will be described in detail below, scarcely occurs in the present toner, resulting in realizing a high quality copied image for a long period of time. Since the toner of the present invention has no charge control agent, it is impossible to detect any charge control agent, i.e., a dye type compound, from the toner by any chemical or physical method. For example, such a compound cannot be detected in the present toner by any chemical reaction. Alternatively, absorption peaks owing to such a compound cannot be detected in an organic solvent extracted solution of the present toner. For example, when the present toner is extracted with an organic solvent such as methanol, the extracted solution has substantially no absorption peak in the range of 280 to 350 nm, and has substantially zero absorbance in the range of 400 to 700 nm. Herein, "to have substantially no absorption peak" means, in an extracted solution obtained by extracting 0.1 g of the present toner with 50 ml of methanol, absorption peaks are not detected at all, or if detected, values of the absorbance peaks are 0.05 or less. Similarly, "to have substantially zero absorbance" means that values of the absorbance of the extracted solution obtained by extracting 0.1 g of the present toner with 50 ml of methanol are 0.05 or less.

In the present toner, instability of the charge of the toner due to a lack of a charge control agent is compensated for as follows. First, a polymer having an anionic group is used as a binder resin of a toner particle; and secondly, magnetic powder is contained in the toner particle at a predetermined proportion. In the present toner, in order to further enhance the function of the toner, the binder resin is made of a composition containing a resin including a low molecular weight polymer and a high molecular weight polymer, and both the polymers have an anionic group. This results in further decreasing charge failure of the toner. Furthermore, spacer particles having a desired particle diameter are attached on the surfaces of the toner particles, if necessary, thereby increasing the transfer efficiency of the toner.

The above-mentioned characteristics of the present toner will be described in detail.

Figure 1:
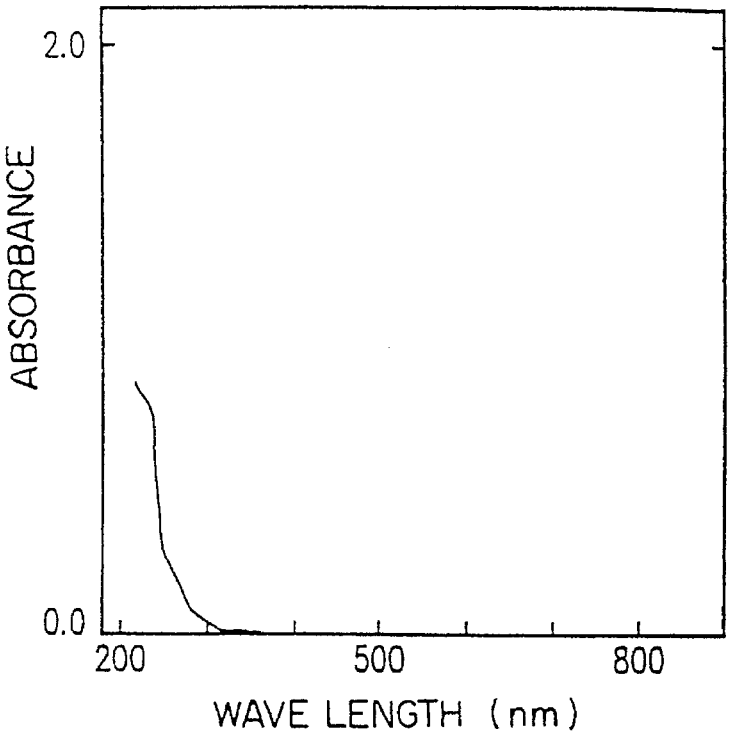
FIG. 1 is a graph showing absorbance of a methanol extracted solution of toner according to the present invention in the range of 200 to 700 nm.

FIG. 1 shows an UV-visible spectrum of a methanol extracted solution of the present toner in the range of 200 to 700 nm. As is shown in this spectrum, the extracted solution has no peak, which is otherwise formed because of a charge control agent. Specifically, the solution has substantially no absorption peak in the range of 280 to 350 nm, and the absorbance in the range of 400 to 700 nm is substantially zero. To the contrary, in an absorbance curve of a methanol extracted solution of toner having a dye of an azo compound—chrome complex as a charge control agent shown in FIG. 2, absorption peaks are found in the range of 400 to 700 nm, in particular, 550 to 570 nm. Further, in the UV-visible spectrum of a methanol extracted solution of toner having a salicylic acid—metal complex as a charge control agent shown in FIG. 3, an absorption peak is found in the range of 280 to 350 nm.

It is because the charge control agent is present on the surfaces of the toner particles at a rather high concentration that the methanol extracted solution of the toner having the charge control agent has absorption peaks due to the charge control agent.

Figure 2:
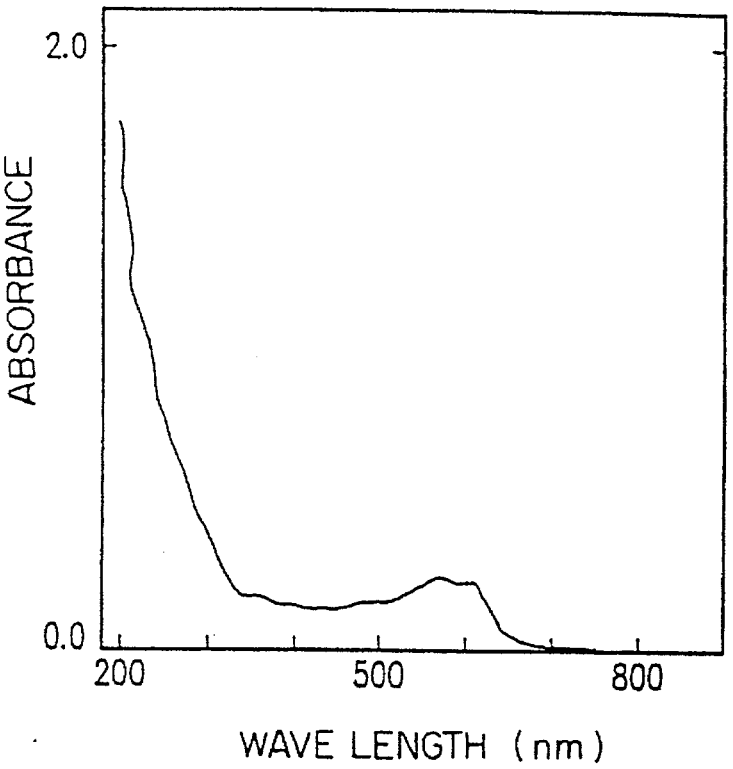
FIG. 2 is a graph showing absorbance of a methanol extracted solution of toner having a dye of an azo compound—chrome complex as a charge control agent in the range of 200 to 700 nm.
Figure 3:
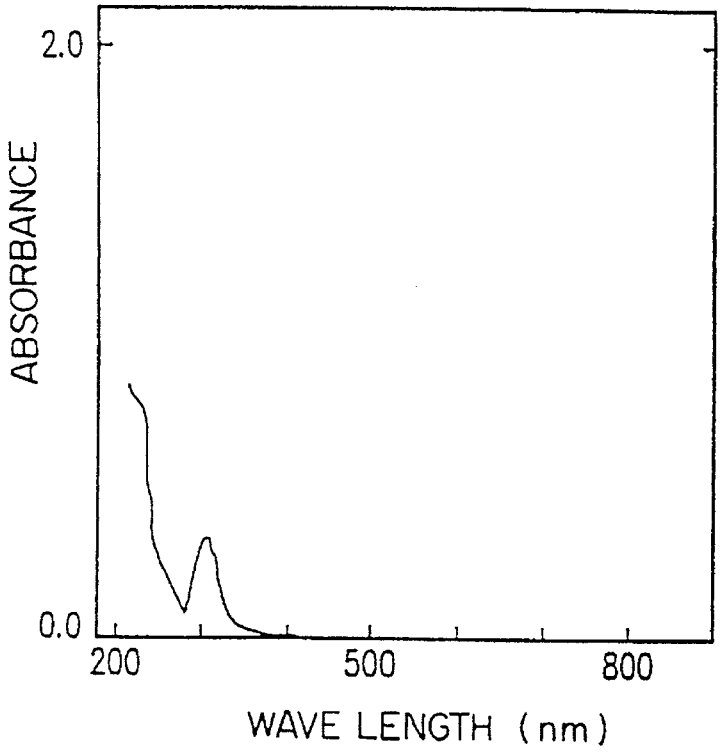
FIG. 3 is a graph showing absorbance of a methanol extracted solution of toner having a salicylic acid—metal complex as the charge control agent in the range of 200 to 700 nm.
Figure 4:
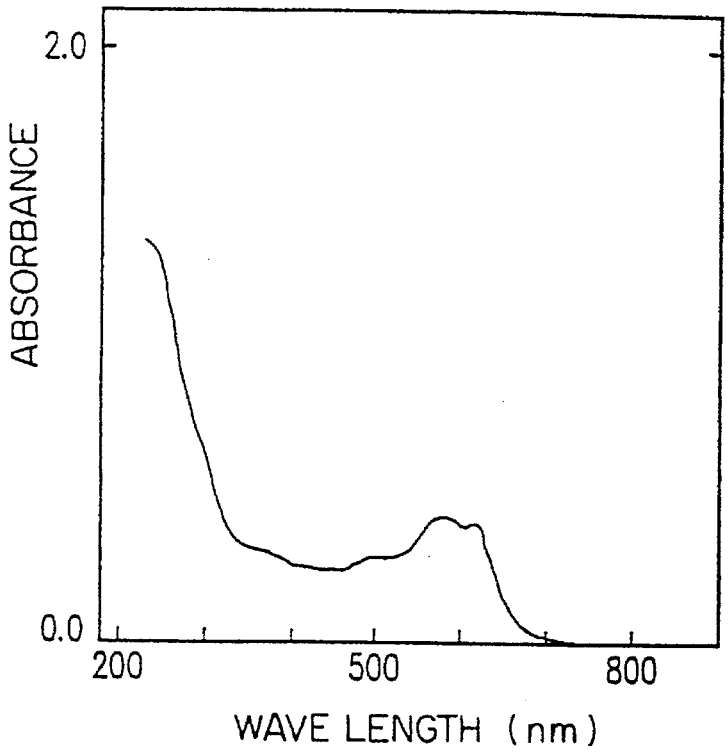
FIG. 4 is a graph showing absorbance of a methanol extracted solution of carrier in a two-component magnetic developer used for a long time in which toner has a dye of an azo compound—chrome complex as the charge control agent and chargeability of carrier is unstabilized by a spent in the range of 200 to 700 nm.

A carrier included in a developer which has insufficient chargeability owing to occurrence of a spent is extracted with methanol, and then the UV-visible spectrum of the extracted solution is measured to find absorption peaks in the range of 400 to 700 nm derived from a charge control agent. For example, the developer comprising the toner having a dye of an azo compound—chrome complex, whose UV-visible spectrum is shown in FIG. 2, was used for a long period of time to cause a spent therein. Then, UV-visible spectrum of a methanol extracted solution of the carrier in this developer was measured to give the spectrum shown in FIG. 4. As is shown in FIG. 4, absorption peaks are found at the same position as the spectrum in FIG. 2. It is conventionally understood that a spent is caused because a binder resin in the toner is attached to the surface of a carrier particle to form a resin film. The comparison between the absorbance curves in FIGS. 2 and 4, however, reveals that one of the major causes of a spent is the transfer of the charge control agent from the toner particles to the carrier particles.

Figure 5:
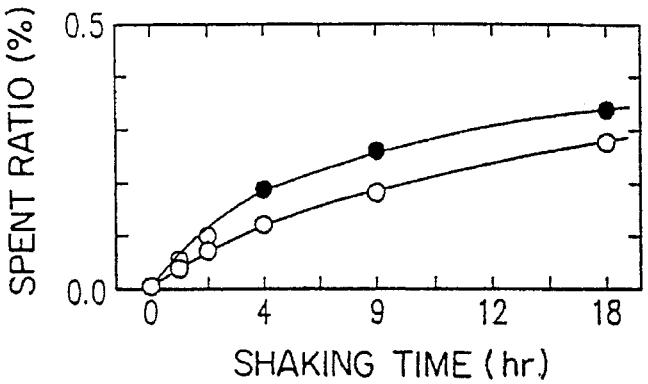
FIG. 5 is a graph showing a relationship between shaking time and a spent ratio obtained with regard to two kind of a two-component magnetic developer, one comprising toner having a charge control agent and magnetic carrier and another comprising toner having no charge control agent and magnetic carrier.
Figure 6:
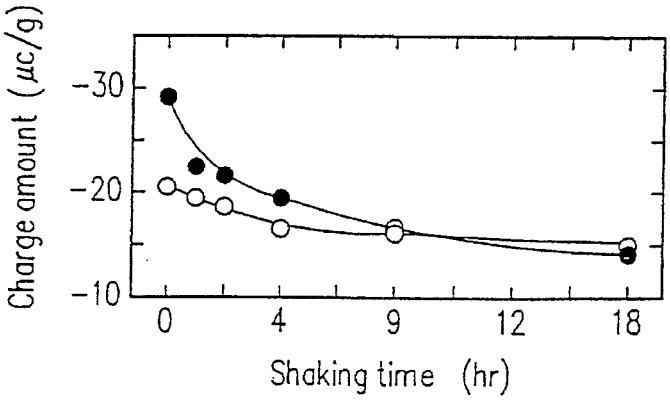
FIG. 6 is a graph showing a relationship between shaking time and quantity of charge of toner obtained with regard to two kind of a two-component magnetic developer, one comprising toner having a charge control agent and magnetic carrier and another comprising the toner having no charge control agent and magnetic carrier.

The present inventors conducted the following experiments in order to find out more about the relationship between a charge control agent and a spent: First, toner comprising toner particles containing 1.5 wt % of the dye of the azo compound—chrome complex was mixed with a carrier to obtain a developer. The toner and the carrier was shaken for a predetermined period of time. FIG. 5 shows a relationship between the shaking time and amount of an attachment on the surfaces of the carrier particles. In FIG. 5, the amount of attachment is indicated as a spent ratio, that is, a percentage based on a total weight of the carrier particles bearing the attachment. Furthermore, FIG. 6 shows the relationship between the shaking time and the amount of charge of the toner. The same procedure was repeated with regard to a developer comprising toner having no charge control agent and carrier. The experimental results of this developer are also shown in FIGS. 5 and 6, wherein the results obtained by the developer including the toner having the charge control agent are plotted with black circles, and those by the developer including the toner having no charge control agent are plotted with white circles. It is apparent from FIGS. 5 and 6 that a larger amount of attachment is formed on the carrier particles as the spent and the charge amount of the toner has a greater decrease in the developer including the toner particle having the charge control agent than in the developer including the toner particle having no charge control agent.

Figure 7:
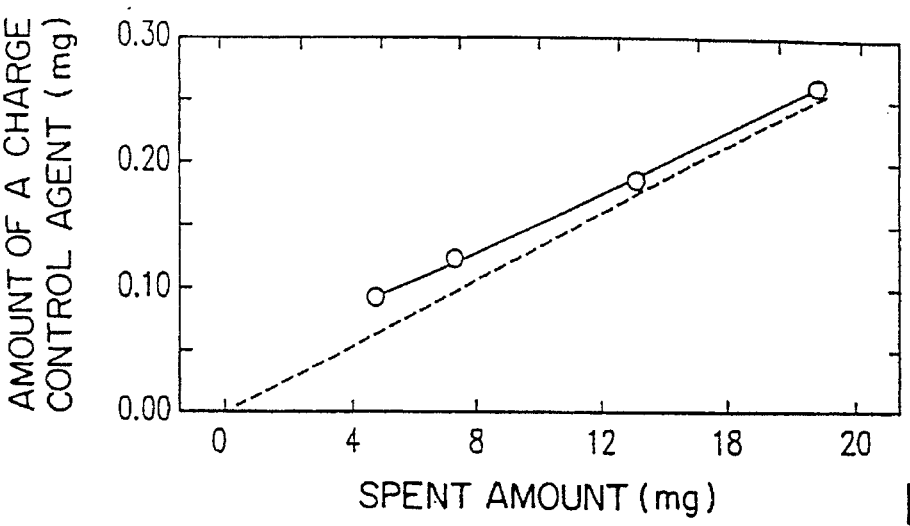
FIG. 7 is a graph showing a relationship between an amount of spent of carrier and content of a charge control agent in a toner particle.

Next, the weight of toner components attached on the surfaces of the carrier particles as the spent was measured with time. The results are shown in a graph of FIG. 7, wherein the abscissa indicates a measured amount of the spent and the ordinate indicates the content of the charge control agent in the toner particle. The broken line in FIG. 7 indicates the amount of the charge control agent calculated in assuming that the toner components attached as the spent are identical to the components in the toner particles. FIG. 7 reveals that a large amount of the charge control agent is deposited to be attached on the surfaces of the carrier particles at the initial stage. In FIG. 7, as amount of the spent increases, the measured values approximate the calculated values. This is because they are experimental results obtained in a close system having no supply of fresh toner. Therefore, when toner is exchanged as in a copying machine, the difference between the measured values and the calculated values would be much larger.

Figure 8:
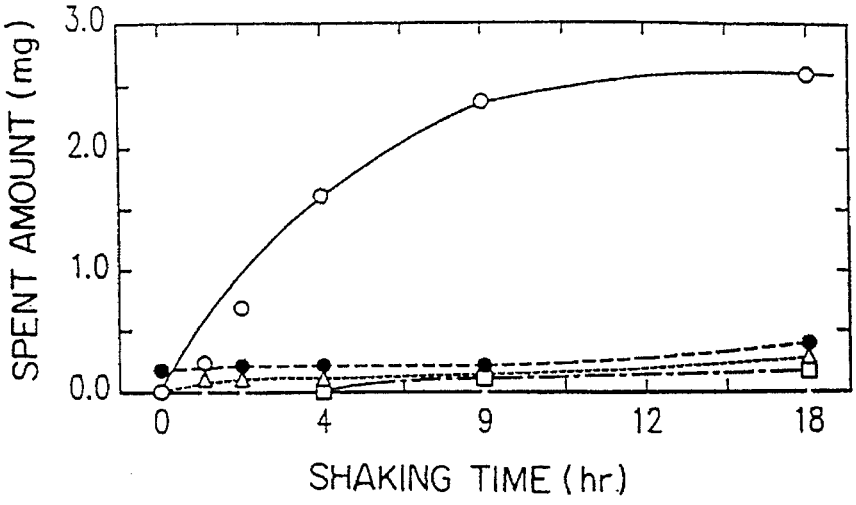
FIG. 8 is a graph showing a relationship between shaking time and amount of spent obtained in the case where each component contained in a toner particle and magnetic carrier are individually mixed and shaken.

Furthermore, the present inventors measured the weight of the attachment on the surfaces of the carrier particles resulting from mixing the carrier with each of the toner components, that is, a charge control agent, a binder resin, carbon black as a coloring agent and wax, so as to find out the relationships between the respective toner components and the spent. The results are shown in FIG. 8 as a variation with time in the amount of the attachment (i.e., amount of the spent), wherein the results obtained from the mixture with the charge control agent is plotted with white circles, those from the carbon black with black circles, those from the binder resin with squares, and those from the wax with triangles. It is apparent from FIG. 8 that the charge control agent causes the largest amount of attachment due to the spent.

Figure 9:
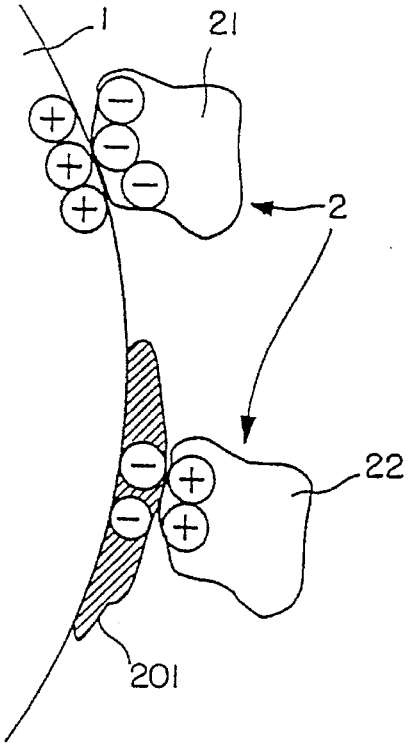
FIG. 9 illustrates a mechanism of a charge failure caused by a spent in a conventional two-component magnetic developer.

Based on the above-mentioned facts, the charge failure caused by the spent in a conventional two-component magnetic developer is explained as follows referring to FIG. 9. In the initial stage of the usage of a developer, a carrier particle i is positively charged and a toner particle 2 is negatively charged as is shown in an upper portion of FIG. 9. In this case, the toner particle works as a negative toner particle 21. When this developer is continued to be used, a component including the charge control agent as a main component in the toner particle is attached on the surface of the carrier particle 1. Attachment 201, which is the spent, is negatively charged. The negatively charged attachment 201 leads to the formation of a toner particle having positive charge, that is, a reversely charged toner particle 22. The reversely charged toner particle 22 is formed on the surface of the carrier particle 1 as is shown in a lower portion of FIG. 9, resulting in scattering of the toner and decreasing the transfer efficiency of the toner.

As described above, preferably, the toner does not have a charge control agent not only because the agent can include a heavy metal but also because the agent is the main cause of the spent, scatter of the toner and of a decrease in the transfer efficiency of the toner. Accordingly, the present toner has no charge control agent at all.

The instability of charge of the toner due to the lack of the charge control agent, in particular, the insufficiency in charge amount of the toner is compensated by using a binder resin having an anionic group as mentioned above. The insufficiency in charge amount of the toner particles can be supplemented because the binder resin has a negative charge in itself owing to the anionic group included therein. Since the anionic group is bonded to the main chain of the binder resin, it would never move onto the surface of the carrier particle as the charge control agent does, and hence it never causes the spent. On the contrary, charge around the surface of the toner particle caused by the anionic group of the binder resin is not so large that the electrostatic attraction between the toner particle and the carrier particle owing to the Coulomb force is insufficient when they are conveyed as a magnetic brush for development. Therefore, in a rapid copying operation, the toner cannot be sufficiently prevented from scattering because of insufficient coupling with the carrier particles. The scattered toner stains the inner wall of the copying machine, and can cause so-called a fog on a copied image.

In order to overcome such disadvantages, the present toner includes magnetic powder at a predetermined proportion, that is, 0.1 to 5 parts by weight on the basis of 100 parts by weight of the binder resin. The insufficiency in the charge amount of the toner particles can be thus compensated for. The magnetic powder contained in the toner particle causes magnetic attraction between the toner particle and the carrier particle. This magnetic attraction between the toner particle and the carrier particle together with electrostatic attraction prevents the toner from scattering. Moreover, since the number of the toner particles to be attached onto an electrostatic latent image is increased as the charge amount of one toner particle is smaller, apparent development sensitivity is increased.

The content of the magnetic powder in the toner particles is in the range of 0.1 to 5 parts by weight per 100 parts by weight of the binder resin as described above. When the content is less than 0.1 parts by weight, the charge amount of the toner particle is insufficient, resulting in insufficient coupling with the carrier particle and causing toner scattering. In this case, a fog can be disadvantageously formed on a copied image. Furthermore, the density of the copied image is low because of the insufficient charge amount. When the contents exceeds 5 parts by weight, the magnetic attraction between the carrier particle and the toner particle becomes so strong that the toner is not sufficiently attached onto an electrostatic latent image, resulting in decreasing the density of the copied image.

Several attempts have been made to improve the resolution of a copied image and the like by including (inclusively adding) magnetic powder as a toner component. For example, Japanese Laid-Open Patent Publication No.

56-106249 discloses a toner particle including 10 wt % of ferrite, and Japanese Laid-Open Patent Publication No. 59-162563 discloses a toner particle including 5 through 35 wt % of a magnetic fine particle. In either case, however, the content of the magnetic powder is excessive, and hence, the density of the copied image is low. Japanese Laid-Open Patent Publication No. 3-67268 discloses toner to which 0.05 to 2 wt % of magnetic powder is externally added. In this case, since the magnetic powder is not included in the toner particle, the powder is likely to be ununiformly attached onto the surface of the toner particle, resulting in insufficient magnetic attraction between the toner particle and the carrier particle. Furthermore, in either of the above-mentioned toners, the spent can be disadvantageously caused because a charge control agent is contained therein.

In the present toner, the binder resin is made of a composition including a low molecular weight polymer and a high molecular weight polymer both having an anionic group in order to further enhance the functions of the toner. Because of such a comparatively wide range of the distribution of the molecular weight, the fixability of the toner onto transfer paper is improved. In particular, since the low molecular weight polymer contained in the binder resin has a low melting point and is soft, it plays an important role to improve the fixability.

In one aspect of the present invention, the acid value of the low molecular weight polymer is preferably lower than that of the high molecular weight polymer. As a result, the generation of the reversely charged toner particles can be suppressed, thereby preventing the charge failure from occurring in the toner and improving the durability thereof. The low molecular weight polymer contained in the binder resin is more likely to be attached onto the surfaces of the carrier particles due to the friction with the carrier particles as compared with the high molecular weight polymer. When attached onto the surfaces of the carrier particles, the low molecular weight polymer including an anionic group (such as a carboxyl group) is likely to charge the toner into the reverse polarity. Therefore, by lowering the acid value of the low molecular weight polymer contained in the binder resin included in the toner particles, the toner particles are suppressed to be charged into the reverse polarity even when the low molecular weight polymer is attached onto the carrier.

In another aspect of the invention, it is preferable that the binder resin includes a low molecular weight polymer and a high molecular weight polymer, both including styrene, and a monomer having an anionic group, and that the content of styrene in the low molecular weight polymer is 70% or less. Under this condition, even when the content of styrene is small, it is preferable that the proportion of the anionic group is not extremely increased consequently upon the small content of styrene. By specifying the content of styrene that is likely to be negatively charged within a predetermined range, the low molecular weight polymer is prevented from attaching onto the carrier, namely, the charge failure of the toner caused by a spent can be avoided.

In still another aspect of the invention, it is preferred that the content of the anionic group in the low molecular weight polymer is smaller than that in the high molecular weight polymer, and that the low molecular weight polymer has a smaller SP value than the high molecular weight polymer. When such a condition is met, the compatibility between these polymers can be decreased, thereby concentrating a shearing force on the interface of the low molecular weight polymer that is comparatively soft when the resultant toner is crushed. As a result, the crushability of the toner can be increased. In addition, the charge failure of the toner would not be caused.

In still another aspect of the invention, it is preferable that the binder resin including the low molecular weight polymer and the high molecular weight polymer is made of a composition including a styrene-acrylic resin having an anionic group, and that the peak of the molecular weight of the styrene-acrylic resin is in the range between 4,000 and 30,000. When the resin having the molecular weight peak within this range is used, the durability and the crushability of the toner can be improved. The weight-average molecular weight of the resin is preferably in the range between 70,000 and 200,000. When such a resin is used, the crushability of the resultant toner is satisfactorily improved. Further, the acid value of the resin can be in the range between 4 and 20. The acid value within this range can further improve the chargeability of the toner. The anti-spent property and the fixability of the toner, and the crushability in the production procedure of the toner can be well balanced in this manner, thereby improving all of these characteristics.

In the present invention, spacer particles having a particle diameter of 0.05 through 1.0 μm are attached preferably onto the surfaces of the toner particles in order to increase the transfer efficiency of the toner image. The spacer particles can work to enhance fluidity of the toner, and in addition, form a gap between the photosensitive body and the toner particles when the toner is attached onto the electrostatic latent image formed on the photosensitive body. Therefore, the toner can be transferred from the photosensitive body onto the transfer paper with ease even when the toner attains a large quantity of charge through a long copying operation, resulting in a high transfer efficiency of the toner. When the spacer particle is similar to the particle of the magnetic powder included in the toner particle, the magnetic attraction between the toner particle and the carrier particle can be further enhanced, thereby further preventing toner scattering and a fog.

A fine particle having a particle diameter of approximately 0.015 μm is used to enhance fluidity of a conventional toner. Such a small particle cannot form a sufficient gap between the photosensitive body and the toner particles, and cannot work as the spacer particle for the aforementioned purposes.

Now, preferable resins to be used as the binder resin in the present toner will be described. Herein, a "lower alkyl group" indicates alkyl having 1 to 5 carbon atoms.

Binder resin

The binder resin contained in the toner particles of the present toner is made of a composition containing a resin including a low molecular weight polymer and a high molecular weight polymer both having an anionic group. The high molecular weight polymer herein indicates a polymer with a molecular weight of 100,000 or more, and the low molecular weight polymer herein indicates a polymer with a molecular weight of less than 100,000.

The peak of the molecular weight of the low molecular weight polymer is preferably in the range between 4,000 and 30,000. When it is less than 4,000, the anti-spent property cannot be expected to be improved, and the durability is likely to be decreased. When it exceeds 30,000, the crushability is likely to be decreased.

Further, the weight-average molecular weight of the entire binder resin is preferably in the range between 70,000 and 200,000. When it is less than 70,000, the resultant toner is overground, and hence the resultant toner particles can be broken with ease. When it exceeds 200,000, the crushability of the toner is likely to be decreased.

The binder resin contained in the toner particles of the present toner comprises a composition including a polymer having an anionic group. Such a binder resin is obtained by polymerizing a monomer having an anionic group or a mixture of the monomer having an anionic group with other monomers. The obtained resin can be a homopolymer or a copolymer.

The binder resin used in the present toner is preferably a copolymer, such as a randam copolymer, a block copolymer and a grafted copolymer, obtained from a monomer having an anionic group and other monomers.

Examples of the monomer having an anionic group include monomers having a carboxylic acid group, a sulfonic acid group or a phosphoric acid group, and a monomer having a carboxylic acid group is generally used. Examples of the monomer having a carboxylic acid group include ethylenically unsaturated carboxylic acids such as acrylic acid, methacrylic acid, crotonic acid, maleic acid and fumaric acid; monomers that can form a carboxylic acid group such as maleic anhydride; and lower alkyl halfester of dicarboxylic acid such as maleic acid and fumaric acid. Examples of the monomer having a sulfonic acid group include styrene sulfonic acid and 2-acrylamido-2-methylpropane sulfonic acid. Examples of the monomer having a phosphoric acid group include 2-phosphono (oxy) propylmethacrylate, 2-phosphono (oxy) ethylmethacrylate, 3-chloro-1-phosphono(oxy) propylmethacrylate.

Such a monomer having an anionic group can be a free acid, a salt of an alkaline metal such as sodium and potassium, a salt of an alkaline earth metal such as calcium and magnesium, and a salt such as zinc.

The monomer having no anionic group used to prepare the binder resin is selected so that the resultant binder resin has a sufficient fixability and chargeability required of toner, and is one or a combination of an ethylenically unsaturated monomer. Examples of such a monomer include ethylenically unsaturated carboxylic acid ester, monovinyl arene, vinyl ester, vinyl ether, diolefin and monoolefin.

The ethylenically unsaturated carboxylic acid esters are represented by the following Formula (I):

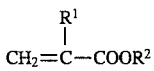

(I)

wherein $R^1$ is a hydrogen atom or a lower alkyl group; and $R^2$ is a hydrocarbon group having 11 or less carbon atoms or a hydroxyalkyl group having 11 or less carbon atoms.

Examples of such ethylenically unsaturated carboxylic acid esters include methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, β-hydroxyethylacrylate, γ-hydroxypropylacrylate, δ-hydroxybutylacrylate and β-hydroxyethylmethacrylate.

The monovinyl arenes are represented by the following Formula (II):

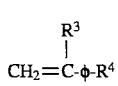

(II)

wherein $R^3$ is a hydrogen atom, a lower alkyl group or a halogen atom; $R^4$ is a hydrogen atom, a lower alkyl group, a halogen atom, an alkoxy group, an amino group or a nitro group; and ϕ is a phenylene group.

Examples of such monovinyl arene include styrene, α-methylstyrene, vinyltoluene, α-chlorostyrene, o-chlorostyrene, m-chlorostyrene, p-chlorostyrene and p-ethylstyrene.

The vinyl esters are represented by the following Formula (III):

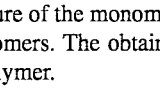

(III)

wherein $R^5$ is a hydrogen atom or a lower alkyl group.

Examples of such vinyl esters include vinyl formate, vinyl acetate and vinyl propionate.

The vinyl ethers are represented by the following Formula (IV):

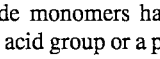

(IV)

wherein $R^6$ is a monovalent hydrocarbon group having 11 or less carbon atoms.

Examples of such vinyl ethers include vinyl methyl ether, vinyl ethyl ether, vinyl n-butyl ether, vinyl phenyl ether and vinyl cyclohexyl ether.

The diolefins are represented by the following Formula (V):

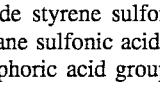

(V)

wherein $R^7$, $R^8$ and $R^9$ are independently a hydrogen atom, a lower alkyl group or a halogen atom.

Examples of such diolefins include butadiene, isoprene and chloroprene.

The monoolefins are represented by the following Formula (VI):

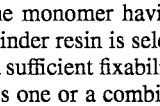

(VI)

wherein $R^{10}$ and $R^{11}$ are independently a hydrogen atom or a lower alkyl group.

Examples of such monoolefins include ethylene, propylene, isobutylene, 1-butene, 1-pentene and 4-methyl-1-pentene.

Specific examples of the polymer having an anionic group, that is, a (co)polymer obtained through the polymerization of the aforementioned monomers, include styrene-acrylic acid copolymers, styrene-maleic acid copolymers and ionomer resins. Furthermore, a polyester resin having an anionic group can be also used.

A preferable binder resin is a copolymer obtained from the monomer having an anionic group and at least one of the ethylenically unsaturated carboxylic acid ester represented by Formula (I) as an indispensable components, and any of the monomers represented by Formulae (II) through (VI) as an optional component to be used if necessary. One or a combination of two or more of the aforementioned monomers is used for preparing the binder resin.

In the present invention, the low molecular weight polymer is preferably a copolymer including a styrene component. The weight ratio of styrene against entire used monomers in the production of the low molecular weight polymer is 70% or less, and preferably 20% through 65%. When it exceeds 70%, the charge failure of the resultant toner is likely to be caused with ease. As a result, the durability of the toner is decreased.

The copolymer including a styrene component is obtained by copolymerizing a monomer including an monovinyl arene monomer. Preferably, the binder resin is a styrene acrylic resin.

In the present toner, it is preferable that the acid value of the low molecular weight polymer in the binder resin is smaller than that of the high molecular weight polymer. In particular, when the anionic group is present as a free acid, the acid value of the low molecular weight polymer is 3 through 15. It preferable that the acid value of the high molecular weight polymer is 6 through 25, and that the ratio in the acid value of the high molecular weight polymer to that of the low molecular weight polymer is in the range from 1:1.2 to 1:8. When the acid value of the low molecular weight polymer exceeds the aforementioned range, and when the ratio in the acid value is below the aforementioned range, the charge failure is likely to be caused in the resultant toner.

The resin including the high molecular weight polymer and the low molecular weight polymer can be obtained by, as described below, producing the low molecular weight polymer first, and then adding a monomer thereto as a material for the high molecular weight polymer to be polymerized together. Alternatively, the respective polymers can be separately produced and mixed with each other. It is preferable that the resin includes the anionic group at a proportion for attaining the acid value of the entire resin in the range between 4 and 20, and preferably between 5 and 15, when the anionic group is present as a free acid. When part or the entire anionic group is neutralized, the anionic group is preferably contained at such a proportion that the acid value would be within the aforementioned range in assuming that it is present as a free acid. When the acid value, i.e., the concentration of the anionic group, of the polymer or the composition is below the aforementioned range, the chargeability of the resultant toner is insufficient. When it exceeds the range, the resultant toner disadvantageously has a hygroscoplc property.

The binder resin used in the invention is made of the composition including the aforementioned polymers, and the composition can further include a polymer having no anionic group as well. In this case, the proportion of the anionic group in the entire composition is preferably within the aforementioned range.

Preferable production method for the binder resin

The binder resin including the low molecular weight polymer and the high molecular weight polymer can be produced as follows by using a monomer having an anionic group and any of the aforementioned monomers having no anionic group: For example, a monomer having an anionic group, a monomer including at least one of the aforementioned monomers having no anionic group, and a polymerization initiator are dissolved in a solvent such as toluene and xylene with stirring. The resultant mixture is charged in a reactor, and polymerized at a temperature of 60° C. through 250° C. for 3 through 10 hours with stirring the mixture with an impeller. Then, the solvent is removed, and the residue is dried to give a low molecular weight polymer. Next, a monomer having an anionic group, a monomer including at least one of the aforementioned monomers having no anionic group, the low molecular weight polymer and a polymerization initiator are dissolved in a solvent with stirring. The resultant mixture is charged in a reactor and polymerized at a temperature of 60° C. through 200° C. for 5 through 24 hours with stirring the mixture with an impeller. Then, the solvent is removed, and the residue is dried to give a binder resin including the low molecular weight polymer and a high molecular weight polymer.

Magnetic powder

The magnetic powder contained in (inclusively added to) the toner particles can be any magnetic powder used in a conventional one-component type developer. Examples of the material for the magnetic powder include triiron tetroxide ($Fe_3O_4$), maghemite ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodyum iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron (Fe), cobalt (Co) and Nickel (Ni). Particularly preferable magnetic powder is made from triiron tetroxide (magnetite) in the shape of fine particles. The particle of preferable magnetite is in the shape of a regular octahedron with a particle diameter of 0.05 through 1.0 μm. Such a magnetite particle can be subjected to a surface treatment with a silane coupling agent or a titanium coupling agent. The particle diameter of the magnetic powder contained in the toner particle is generally 1.0 μm or smaller, and preferably in the range between 0.05 and 1.0 μm.

The content of the magnetic powder in the toner particle is in the range of 0.1 to 5 parts by weight, more preferably 0.5 to 4 parts by weight, and most preferably 0.5 to 3 parts by weight per 100 parts by weight of the binder resin. When the content is too small, the toner can be scattered during the development and the transfer efficiency of the toner can be decreased as described above.

Inner additives in the toner particles

The toner particle contains, as described above, the binder resin and the magnetic powder as indispensable components, and can optionally include some inner additive generally used for a toner, if necessary.

Examples of such additives include a coloring agent and a release agent.

As the coloring agent, the following pigments can be used:

Black pigment:

carbon black, acetylene black, lampblack, aniline black;

Extender:

barite powder, barium carbonate, clay, silica, white carbon, talc, alumina white.

Such a pigment is contained in the toner particle in the range of 2 to 20 parts by weight, and preferably 5 to 15 parts by weight per 100 parts by weight of the binder resin.

As the release agent, various wax and olefin resins can be used as in a conventional toner. Examples of the olefin resin include polypropylene, polyethylene, and propylene-ethylene copolymers, and polypropylene is particularly preferred.

Preparation of the toner

The toner particles in the present toner can be produced by any ordinary method for toner particles such as crushing and classification, fusing granulation, spray granulation and polymerization, and are generally produced by the crushing and classification method.

For example, the components for the toner particles are previously mixed in a mixer such as a Henschel mixer, kneaded with a kneader such as a biaxial extruder, and then cooled. The resultant is crushed and classified to give toner particles. The particle diameter of the toner particle is generally in the range between 5 and 15 μm and preferably between 7 and 12 μm in the volume-base averaged particle diameter (a medium size measured with a Coulter counter).

It is possible to improve the fluidity of the toner by attaching, as an outer additive, a fluidity enhancer such as hydrophobic vapor depositioned silica particles onto the surfaces of the toner particles, if necessary. The primary particle diameter of the fluidity enhancer such as the silica particles is generally approximately 0.015 μm, and such a fluidity enhancer is added to the toner in the range of 0.1 to 2.0 percent by weight on the basis of the weight of the entire toner, i.e., the total weight of the toner particles and the fluidity enhancer.

Furthermore, spacer particles having a larger particle diameter than that of the fluidity enhancer are preferably added in the present invention. As the spacer particles, any of organic and inorganic inactive particles with a particle diameter of 0.05 through 1.0 μm, more preferably 0.07 through 0.5 μm can be used. Examples of the material for such inactive particles include silica, alumina, titanium oxide, magnesium carbonate, an acrylic resin, a stytens resin and magnetic materials. The spacer particle can not only work as a fluidity enhancer but also increase the transfer efficiency as described above. As the spacer particle, the same type of magnetic powder as included in the toner particle, in particular, triiron tetroxide (magnetite) in the shape of fine particle is preferably used. The magnetic powder, when used as the spacer particles, effectively suppresses the scattering of the toner as described above. The content of the spacer particles is 10 percent by weight or less, more preferably in the range of 0.1 to 10 percent by weight, and most preferably 0.1 to 5 percent by weight on the basis of the total weight of the toner. When the spacer particles are excessively included in toner, the density of a copied image is insufficient. When the magnetic powder is used as the spacer particles, the total amount of the magnetic powder together with that contained in the toner particles is preferably 10 parts by weight or less per 100 parts by weight of the binder resin. When it is excessively included, the density of a copied image can be decreased.

When the fluidity enhancer and the spacer particles are added to the toner particles, the following production method is preferred. The fluidity enhancer and the spacer particles are first sufficiently mixed with each other, and then the obtained mixture is added to the toner particles, and then is sufficiently unbound. Thus, the spacer particles can be attached onto the surfaces of the toner particles. To "be attached" herein means both to be held in contact with the surface of the toner particle and to be partly embedded in the toner particle. In this manner, the toner of the present invention is produced.

Carrier particle

In the present invention, generally used magnetite or ferrite can be used as a carrier for the two-component type developer. In such a compound, the electrical resistance is stable and varies very little with time or by the change of the environment, and hence, it can provide the resultant developer with a stable chargeability. Further, such a compound is formed into a soft spicated shape in the developing apparatus when a magnetic field is applied. This prevents the turbulence of a toner image formed on the photosensitive body, thereby suppressing the formation of a white stripe in a copied image. The ferrite can be preferably used.

The carrier particle in the carrier used in the present invention is more preferably formed from a particle having a two-layered structure including a core particle and a coating layer over the core particle. The core particle comprises a magnetic material represented by the following Formula (A):

$$MOFe_2O_3 \quad (A)$$

wherein M is at least one metal selected from the group consisting of Cu, Zn, Fe, Ba, Ni, Mg, Mn, Al and Co.

The compound represented by Formula (A) is magnetite (wherein M is Fe) or ferrite (wherein M is one of the metals other than Fe), and ferrite, wherein M is Cu, Zn, Mn, Ni or Mg, is preferably used. Change of the electrical resistance of such magnetite and ferrite is little for a long time, and the magnetite and ferrite can be formed into a soft spicated shape in the developing apparatus when a magnetic field is applied. The core particle comprising such a magnetic material has a particle diameter between 30 and 200 μm, and preferably between 50 and 150 μm. The core particles are obtained by granulating the fine particles of the magnetic material by spray granulation and the like, and then heating the resultant particles. The core particle has a volume specific resistivity between $10^5$ and $10^9$ Ω·cm, and preferably between $10^6$ and $10^8$ Ω·cm. The saturation magnetization of the core particle is in the range of 30 to 70 emu/g, and preferably between 45 and 65 emu/g.

The resin having a cationic group included in the resin composition, which forms the coating layer of the carrier particle, can be a thermoplastic resin and a thermosetting resin, and is preferably a thermosetting resin or a mixture of a thermosetting resin and a thermoplastic resin in terms of the heat resistance and the durability. Examples of the cationic group include a basic nitrogen containing group such as primary, secondary and tertiary amino groups, a quaternary ammonium group, an amido group, an imino group, an imido group, a hydrazino group, a guanidino group and an amidino group, among which an amino group and a quaternary ammonium group are particularly preferred.

Examples of the thermoplastic resin having a cationic group include thermoplastic acrylic resins, thermoplastic styrene-acrylic resins, polyester resins, polyamide resins and olefin copolymer, each of which includes a cationic group. Examples of the thermosetting resin include modified and unmodified silicone resins, thermosetting acrylic resins, thermosetting styrerie-acrylic resins, phenol resins, urethane resins, thermosetting polyester resins, epoxy resins and amino resins, each of which includes a cationic group. Such a resin including a cationic group is obtained by polymerizing a monomer having a cationic group or a mixture containing the monomer having a cationic group. Alternatively, such a resin is obtained by linking a compound having a cationic group with a resin having no cationic group. Further alternatively, a monomer having a cationic group and/or another monomer are (co)polymerized by using a polymerization initiator having a cationic group, thereby introducing the cationic group into the resultant resin.

When a resin prepared from alkoxysilane or alkoxytitanium is used, it is possible to produce the resin having a cationic group by allowing a silane coupling agent having a cationic group to react with the resin during or after the preparation of the resin. Examples of the silane coupling agent include N-(2-aminoethyl)-3-aminopropyltrimethoxysilane, N-(2-aminoethyl)-3-aminopropylmethyldimethoxysilane, γ-aminopropyltriethoxysilane and N-phenyl-3-aminopropyltrimethoxysilane. This type of silane coupling agent can be linked onto the surface of the core particle via a hydroxyl group generally present on the surface of the core particle. Therefore, such a silane coupling agent can form the coating layer by itself. Examples of the polymerization initiator having a cationic group include amidine type compound, e.g., azobis compounds.

The resin having a cationic group for forming the coating layer is used singly or together with any other of the aforementioned resins, or together with another resin having no cationic group.

The content of the cationic group in the resin having a cationic group is generally in the range of 0.1 to 2000 mmole, and preferably of 0.5 to 1,500 mmole per 100 g of the resin. When the resin having a cationic group is used with a resin having no cationic group, the cationic group is preferably contained in the entire resins forming the coating layer of the carrier particle at a proportion in the aforementioned range.

The resin composition forming the coating layer of the carrier particle includes at least one of the above-mentioned resins having a cationic group, together with another resin having no cationic group, if necessary. Examples of a mixture of the resin having a cationic group and the resin having no cationic group include a mixture of an alkylated melamine resin and a styrene-acrylic copolymer, and a mixture of an alkylated melamine resin and an acryl-modified silicone resin. The resin composition can further comprise an additive such as silica, alumina, carbon black, fatty acid metal salt, a silane coupling agent and silicone oil. These additives work for regulating physical properties of the coating layer.

Preparation of the carrier

The resin composition including a cationic group is applied to the surface of the core particle by a known method to form the coating layer. For example, the core particle is coated with a solution or a dispersion of the resin composition and dried, thereby forming the coating layer. Alternatively, when a thermosetting resin or a reactive resin oligomer is used, the core particle is coated with an uncured resin, or a solution or a dispersion of the oligomer, and then heated to cure the resin. The coating layer can be formed by any of the generally used methods such as immersion, spray, a fluidized bed method, a moving bed method and a tumbling layer method. As a solvent used to dissolve or disperse the resin composition, any of the ordinary organic solvents can be used. Examples of the solvent include aromatic hydrocarbons such as toluene and xylene; ketones such as acetone, methyl ethyl ketone, methyl isobutyl ketone and cyclohexanone; cyclic ethers such as tetrahydrofuran and dioxane; alcohols such as ethanol, propanol and butanol; cellosolves such as ethyl cellosolve and butyl cellosolve; esters such as ethyl acetate and butyl acetate; and amide type solvents such as dimethylformamide and dimethylacetoamide. The solvent is appropriately selected in accordance with the chemical properties of the resin such as the solubility.

The particle diameter of the thus obtained carrier particle is in the range of 30 to 200 μm, and preferably 50 to 150 μm. The weight ratio of the coating layer on the carrier particle is in the range of 0.001 to 2.5 parts by weight, and preferably 0.005 to 2.0 parts by weight per 100 parts by weight of the core particle. The obtained carrier particle has a volume specific resistivity in the range between $10^5$ and $10^{13}$ Ω·cm, and preferably $10^7$ and $10^{12}$ Ω·cm, and a saturation magnetization in the range between 30 and 70 emu/g, and preferably 45 and 65 emu/g.

Preparation of a developer

A two-component type developer is prepared by mixing the above-mentioned toner and carrier. The mixing ratio of the carrier and the toner is generally 98:2 through 90:10, and preferably 97:3 through 94:6, by weight.

A copying operation is conducted using the present toner by a general electrophotographic method. Specifically, for example, a photoconductive layer on a photosensitive body is uniformly charged, and an image is exposed to form an electrostatic latent image thereon. Then, a magnetic brush made of the two-component magnetic developer is allowed to come in contact with the photosensitive body, thereby developing the electrostatic latent image with ease into a toner image. The thus obtained toner image is transferred onto transfer paper to form a transfer image, which is then applied with heat and pressure by a heat roller to fix the image thereon.

EXAMPLES

The present invention will now be described by way of examples. It is noted that the invention is not limited to these examples.

EXAMPLE 1.1

A. Preparation of a binder resin

Three parts by weight of methacrylic acid, 17 parts by weight of butyl acrylate, 80 parts by weight of styrene and a polymerization initiator were dissolved in a solvent with stirring. The resultant mixture was charged in a reactor and polymerized at a temperature of 160° C. for 6 hours with stirring with an impeller. Then, the solvent was removed, and the residue was dried to give a low molecular weight polymer.

Next, 10 parts by weight of methacrylic acid, 20 parts by weight of butyl acrylate, 70 parts by weight of styrene, a polymerization initiator and 100 parts by weight of the low molecular weight polymer were dissolved in a solvent with stirring. The resultant mixture was charged in a reactor and polymerized at a temperature of 90° C. for 17 hours with stirring with an impeller. Then, the solvent was removed, and the residue was dried to give a binder resin including the low molecular weight polymer and a high molecular weight polymer.

The acid values of the low molecular weight polymer and the high molecular weight polymer in this binder resin were 5 and 15, respectively.

The acid values of these polymers were measured as follows: The toner produced using the binder resin including these polymers was dissolved in a solvent such as a mixed solvent of methanol and THF, and the resultant mixture was subjected to centrifugation to remove carbon black, wax and the like. Then, the high molecular weight polymer and the low molecular weight polymer were. separated from each other, and the acid values thereof were respectively measured.

B. Preparation of toner

| Components of toner | Parts by weight |
|---|---|
| Binder resin[a)] | 100 |
| Coloring agent: Carbon black | 10 |
| Magnetic powder: Magnetite | 2 |

[a)]the polymer obtained in item A.

The above listed components were fused and kneaded with a biaxial extruder, and the resultant was crushed with a jet mill, and classified with a pneumatic classifier to give toner particles with an average particle diameter of 10.0 μm.

To the obtained toner particles were added 0.3 part by weight of hydrophobic silica fine powder with an average particle diameter of 0.015 μm as a fluidity enhancer and 0.6 part by weight of alumina fine particles with an average particle diameter of 0.3 μm as spacer particles, on the basis of 100 parts by weight of the toner particles. The resultant mixture was mixed with a Henschel mixer for 2 minutes to give toner.

C. Preparation of a developer

The thus produced toner was homogeneously mixed with a ferrite carrier with an average particle diameter of 100 μm to give a two-component type developer with a toner concentration of 3.5 wt %.

EXAMPLE 1.2

A. Preparation of a binder resin

Six parts by weight of methacrylic acid, 19 parts by weight of butyl acrylate, 75 parts by weight of styrene and a polymerization initiator were dissolved in a solvent with stirring. The resultant mixture was charged in a reactor and polymerized at a temperature of 160° C. for 6 hours with stirring with an impeller. Then, the solvent was removed, and the residue was dried to give a low molecular weight polymer.

Next, 10 parts by weight of methacrylic acid, 20 parts by weight of butyl acrylate, 70 parts by weight of styrene, a polymerization initiator and 100 parts by weight of the low molecular weight polymer were dissolved in a solvent with stirring. The resultant mixture was charged in a reactor and polymerized at a temperature of 90° C. for 17 hours with stirring with an impeller. Then, the solvent was removed, and the residue was dried to give a binder resin including the low molecular weight polymer and a high molecular weight polymer.

The acid values of the low molecular weight polymer and the high molecular weight polymer in this binder resin were 10 and 15, respectively.

B. Preparation of toner

Toner was prepared in the same manner as in Example 1.1 except that the binder resin produced in item A was used.

C. Preparation of a developer

The thus obtained toner was homogeneously mixed with a ferrite carrier having an average particle diameter of 100 μm to give a two-component type developer with a toner concentration of 3.5 wt %.

EXAMPLE 1.3

A. Preparation of a binder resin

Eight parts by weight of methacrylic acid, 19 parts by weight of butyl acrylate, 73 parts by weight of styrene and a polymerization initiator were dissolved in a solvent with stirring. The resultant mixture was charged in a reactor and polymerized at a temperature of 160° C. for 6 hours with stirring with an impeller. Then, the solvent was removed, and the residue was dried to give a low molecular weight polymer.

Next, 6 parts by weight of methacrylic acid, 24 parts by weight of butyl acrylate, 70 parts by weight of styrene, a polymerization initiator and 100 parts by weight of the low molecular weight polymer were dissolved in a solvent with stirring. The resultant mixture was charged in a reactor and polymerized at a temperature of 90° C. for 17 hours with stirring with an impeller. Then, the solvent was removed, and the residue was dried to give a binder resin including the low molecular weight polymer and a high molecular weight polymer.

The acid values of the low molecular weight polymer and the high molecular weight polymer in this binder resin were 15 and 10, respectively.

B. Preparation of toner

Toner was prepared in the same manner as in Example 1.1 except that the binder resin produced in item A was used.

C. Preparation of a developer

The thus obtained toner was homogeneously mixed with a ferrite carrier having an average particle diameter of 100 μm to give a two-component type developer with a toner concentration of 3.5 wt %.

EXAMPLE 2.1

A. Preparation of a carrier

Spherical ferrite particles with an average particle diameter of 100 μm were used as the magnetic core particles. To 1000 parts by weight of the ferrite particles was added a coating agent with components as listed in Table 1, and the resultant was mixed with a thermal stirrer. The solvent was removed from the resultant mixture, and the residue was subjected to a heat treatment at a temperature of 200° C. for 1 hour to give carrier particles each having a coating layer.

B. Preparation of a developer

The toner produced in Example 1.1 and the thus obtained carrier were homogeneously mixed to give a two-component type developer having a toner concentration of 3.5 wt %.

EXAMPLE 2.2

The same procedure was repeated as in Example 2.1 except that a coating agent with components as listed in Table 1 was used, thereby preparing a developer.

EXAMPLE 2.3

The same procedure was repeated as in Example 2.1 except that a coating agent with components as listed in Table 1 was used, thereby preparing a developer.

EXAMPLE 2.4

The same procedure was repeated as in Example 2.1 except that a coating layer is not formed on a carrier particles without using any coating agent, thereby preparing a developer.

TABLE 1

| | Coating agents of Examples 2.1–2.4 | | | |
|---|---|---|---|---|
| component | Example 2.1 | Example 2.2 | Example 2.3 | Example 2.4 |
| Resin 1 | Acryl-modified silicone | Metylphenyl silicone | Styrene-acrylic polymer | none |
| parts by weight | 2.5 | 4.8 | 3.5 | |
| Resin 2 | Metylated melamine | γ-amino-propyl-triethoxy-silane | Methylated melamine | none |
| parts by weight | 2.5 | 0.2 | 1.5 | |
| Solvent: toluene (parts by weight) | 200 | 200 | 200 | none |

EXAMPLE 3.1

A. Preparation of a binder resin

Ten parts by weight of methacrylic acid, 30 parts by weight of butyl acrylate, 60 parts by weight of styrone and a polymerization initiator were dissolved in a solvent with stirring. The resultant mixture was charged in a reactor and polymerized at a temperature of 150° C. for 5 hours with stirring with an impeller. Then, the solvent was removed, and the residue was dried to give a low molecular weight polymer.

Next, 10 parts by weight of methacrylic acid, 20 parts by weight of butyl acrylate, 70 parts by weight of styrene, a polymerization initiator and 100 parts by weight of the low molecular weight polymer were dissolved in a solvent with stirring. The resultant mixture was charged in a reactor and polymerized at a temperature of 80° C. for 15 hours with stirring with an impeller. Then, the solvent was removed, and the residue was dried to give a binder resin including the low molecular weight polymer and a high molecular weight polymer.

The content of styrene in the low molecular weight polymer contained in the binder resin was 60%.

The content of styrene in the low molecular weight polymer can be calculated based on the amount of styrene and that of entire monomers used in producing the low molecular weight polymer. Alternatively, the resultant toner is dissolved in a solvent such as a mixed solvent of methanol and THF, and the mixture is subjected to centrifugation to remove carbon black, wax and the like. Then, the high molecular weight polymer and the low molecular weight polymer are separated from each other. The content of styrene in the low molecular weight polymer is then measured. In this example, the content was calculated by the former method.

B. Preparation of toner

| Components of toner | Parts by weight |
|---|---|
| Binder resin[a)] | 100 |
| Coloring agent: Carbon black | 10 |
| Magnetic powder: Magnetite | 2 |

[a)]the polymer obtained in item A.

The above listed components were fused and kneaded with a biaxial extruder, and the resultant was crushed with a Jet mill, and classified with a pneumatic classifier to give toner particles with an average particle diameter of 10.0 μm.

To the obtained toner particles were added 0.3 part by weight of hydrophobic silica fine powder with an average particle diameter of 0.015 μm as a fluidity enhancer and 0.6 part by weight of alumina fine particles with an average particle diameter of 0.3 μm as spacer particles, on the basis of 100 parts by weight of the toner particles. The resultant mixture was mixed with a Henschel mixer for 2 minutes to give toner.

C. Preparation of a developer

The thus produced toner was homogeneously mixed with a ferrite carrier with an average particle diameter of 100 μm to give a two-component type developer with a toner concentration of 3.5 wt %.

EXAMPLE 3.2

A. Preparation of a binder resin

Five parts by weight of methacrylic acid, 25 parts by weight of butyl acrylate, 70 parts by weight of styrene and a polymerization initiator were dissolved in a solvent with stirring. The resultant mixture was charged in a reactor and polymerized at a temperature of 150° C. for 5 hours with stirring with an impeller. Then, the solvent was removed, and the residue was dried to give a low molecular weight polymer.

Next, 5 parts by weight of methacrylic acid, 25 parts by weight of butyl acrylate, 70 parts by weight of styrene, a polymerization initiator and 100 parts by weight of the low molecular weight polymer were dissolved in a solvent with stirring. The resultant mixture was charged in a reactor and polymerized at a temperature of 80° C. for 15 hours with stirring with an impeller. Then, the solvent was removed, and the residue was dried to give a binder resin including the low molecular weight polymer and a high molecular weight polymer.

The content of styrene in the low molecular weight polymer contained in the binder resin was 70%.

B. Preparation of toner

Toner was produced in the same manner as in Example 3.1 except that the binder resin produced in item A was used.

C. Preparation of a developer

The thus obtained toner and a ferrite carrier with an average particle diameter of 100 μm were homogeneously mixed to give a two-component type developer having a toner concentration of 3.5 wt %.

EXAMPLE 3.3

A. Preparation of a binder resin

Six parts by weight of methacrylic acid, 14 parts by weight of butyl acrylate, 80 parts by weight of styrene and a polymerization initiator were dissolved in a solvent with stirring. The resultant mixture was charged in a reactor and polymerized at a temperature of 150° C. for 5 hours with stirring with an impeller. Then, the solvent was removed, and the residue was dried to give a low molecular weight polymer.

Next, 6 parts by weight of methacrylic acid, 14 parts by weight of butyl acrylate, 80 parts by weight of styrene, a polymerization initiator and 100 parts by weight of the low molecular weight polymer were dissolved in a solvent with stirring. The resultant mixture was charged in a reactor and polymerized at a temperature of 80° C. for 15 hours with stirring with an impeller. Then, the solvent was removed, and the residue was dried to give a binder resin including the low molecular weight polymer and a high molecular weight polymer.

The content of styrene in the low molecular weight polymer contained in the binder resin was 80%.

B. Preparation of toner

Toner was produced in the same manner as in Example 3.1 except that the binder resin produced in item A was used.

C. Preparation of a developer

The thus obtained toner and a ferrite carrier with an average particle diameter of 100 μm were homogeneously mixed to give a two-component type developer having a toner concentration of 3.5 wt %.

EXAMPLE 4.1

A. Preparation of a carrier

Spherical ferrite particles with an average particle diameter of 100 μm were used as the magnetic core particles. To 1000 parts by weight of the ferrite particles was added a coating agent with components as listed in Table 2, and the resultant was mixed with a thermal stirrer. The solvent was removed from the resultant mixture, and the residue was subjected to a heat treatment at a temperature of 200° C. for 1 hour to give carrier particles each having a coating layer.

B. Preparation of a developer

The toner produced in Example 3.1 and the thus obtained carrier were homogeneously mixed to give a two-component type developer having a toner concentration of 3.5 wt %.

EXAMPLE 4.2

The same procedure was repeated as in Example 4.1 except that a coating agent with components as listed in Table 2 was used, thereby preparing a developer.

EXAMPLE 4.3

The same procedure was repeated as in Example 4.1 except that a coating agent with components as listed in Table 2 was used, thereby preparing a developer.

EXAMPLE 4.4

The same procedure was repeated as in Example 4.1 except that a coating layer is not formed on a carrier particles without using any coating agent, thereby preparing a developer.

TABLE 2

| | Coating agents of Examples 4.1–4.4 | | | |
|---|---|---|---|---|
| component | Example 4.1 | Example 4.2 | Example 4.3 | Example 4.4 |
| Resin 1 | Acryl-modified silicone | Metylphenyl silicone | Styrene-acrylic polymer | none |
| parts by weight | 2.5 | 4.8 | 3.5 | |
| Resin 2 | Metylated melamine | γ-amino-propyl-triethoxy-silane | Methylated melamine | none |
| parts by weight | 2.5 | 0.2 | 1.5 | |
| Solvent: toluene (parts by weight) | 200 | 200 | 200 | none |

EXAMPLE 5.1

A. Preparation of a binder resin

Five parts by weight of methacrylic acid, 35 parts by weight of butyl acrylate, 60 parts by weight of styrene and a polymerization initiator were dissolved in a solvent with stirring. The resultant mixture was charged in a reactor and polymerized at a temperature of 150° C. for 5 hours with stirring with an impeller. Then, the solvent was removed, and the residue was dried to give a low molecular weight polymer.

Next, 15 parts by weight of methacrylic acid, 25 parts by weight of butyl acrylate, 60 parts by weight of styrene, a polymerization initiator and 100 parts by weight of the low molecular weight polymer were dissolved in a solvent with stirring. The resultant mixture was charged in a reactor and polymerized at a temperature of 80° C. for 15 hours with stirring with an impeller. Then, the solvent was removed, and the residue was dried to give a binder resin including the low molecular weight polymer and a high molecular weight polymer.

The SP value of the low molecular weight polymer in the thus obtained binder resin was 9.17, and that of the high molecular weight polymer was 9.36.

The construction of the obtained binder resin is listed in Table 3. The SP value of a crosslinking component (i.e., methacrylic acid; indicated as MAA in Table 3) of 10.73 listed in Table 3 indicates that a polymer obtained by polymerizing methacrylic acid alone has an SP value of 10.73. This also applies to the SP values of a non-crosslinking component (i.e., butyl acrylate; indicated as BA in Table 3) and a styrene component (i.e., styrene; indicated as St in Table 3). Further, the SP values of the polymers in Table 3 indicates the aforementioned SP values calculated based on the amounts of the monomers.

B. Preparation of toner

| Components of toner | Parts by weight |
|---|---|
| Binder resin[a)] | 100 |
| Coloring agent: Carbon black | 10 |
| Magnetic powder: Magnetite | 2 |

[a)]the stylene-acrylic polymer obtained in item A.

The above listed components were fused and kneaded with a biaxial extruder, and the resultant was crushed with a jet mill, and classified with a pneumatic classifier to give toner particles with an average particle diameter of 10.0 μm.

To the obtained toner particles were added 0.3 part by weight of hydrophobic silica fine powder with an average particle diameter of 0.015 μm as a fluidity enhancer and 0.6 part by weight of alumina fine particles with an average particle diameter of 0.3 μm as spacer particles, on the basis of 100 parts by weight of the toner particles. The resultant mixture was mixed with a Henschel mixer for 2 minutes to give toner.

C. Preparation of a developer

The thus produced toner was homogeneously mixed with a ferrite carrier with an average particle diameter of 100 μm to give a two-component type developer with a toner concentration of 3.5 wt %.

EXAMPLE 5.2

A. Preparation of a binder resin

Fifteen parts by weight of methacrylic acid, 10 parts by weight of butyl acrylate, 75 parts by weight of styrene and a polymerization initiator were dissolved in a solvent with stirring. The resultant mixture was charged in a reactor and polymerized at a temperature of 150° C. for 5 hours with stirring with an impeller. Then, the solvent was removed, and the residue was dried to give a low molecular weight polymer.

Next, 5 parts by weight of methacrylic acid, 20 parts by weight of butyl acrylate, 75 parts by weight of styrene, a polymerization initiator and 100 parts by weight of the low molecular weight polymer were dissolved in a solvent with stirring. The resultant mixture was charged in a reactor and polymerized at a temperature of 80° C. for 15 hours with stirring with an impeller. Then, the solvent was removed, and the residue was dried to give a binder resin including the low molecular weight polymer and a high molecular weight polymer.

The SP value of the low molecular weight polymer in the thus obtained binder resin was 9.42, and that of the high molecular weight polymer was 9.23.

The construction of the obtained binder resin is listed in Table 3.

B. Preparation of toner

Toner was produced in the same manner as in Example 5.1 except that the binder resin produced in item A was used.

C. Preparation of a developer

The thus obtained toner and a ferrite carrier with an average particle diameter of 100 μm were homogeneously mixed to give a two-component type developer having a toner concentration of 3.5 wt %.

EXAMPLE 5.3

A. Preparation of a binder resin

Thirteen parts by weight of methacrylic acid, 7 parts by weight of butyl acrylate, 80 parts by weight of styrene and a polymerization initiator were dissolved in a solvent with stirring. The resultant mixture was charged in a reactor and polymerized at a temperature of 150° C. for 5 hours with stirring with an impeller. Then, the solvent was removed, and the residue was dried to give a low molecular weight polymer.

Next, 10 parts by weight of methacrylic acid, 5 parts by weight of butyl acrylate, 85 parts by weight of styrene, a polymerization initiator and 100 parts by weight of the low molecular weight polymer were dissolved in a solvent with stirring. The resultant mixture was charged in a reactor and polymerized at a temperature of 80° C. for 15 hours with stirring with an impeller. Then, the solvent was removed, and the residue was dried to give a binder resin including the low molecular weight polymer and a high molecular weight polymer.

The SP value of the low molecular weight polymer in the thus obtained binder resin was 9.40, and that of the high molecular weight polymer was 9.37.

The construction of the obtained binder resin is listed in Table 3.

B. Preparation of toner

Toner was produced in the same manner as in Example 5.1 except that the binder resin produced in item A was used.

C. Preparation of a developer

The thus obtained toner and a ferrite carrier with an average particle diameter of 100 μm were homogeneously mixed to give a two-component type developer having a toner concentration of 3.5 wt %.

TABLE 3

Constructon of a binder resin including a low and high molecular weight polymer.

| | Example 5.1 | | Example 5.2 | | Example 5.3 | |
|---|---|---|---|---|---|---|
| Polymers | high*1 | low*2 | high | low | high | low |
| Component (parts by weight) | | | | | | |
| ;crosslinker (MMA) (SP value, 10.73) | 15 | 5 | 5 | 15 | 10 | 13 |
| ;non-crosslinker (BA) (SP value, 8.82) | 25 | 35 | 20 | 10 | 5 | 7 |
| ;stylene (St) (SP value, 9.24) | 60 | 60 | 75 | 75 | 85 | 80 |
| SP values of obtained polymers | 9.36 | 9.17 | 9.23 | 9.42 | 9.37 | 9.40 |

*1A high molecular weight polymer.
*2A low molecular weight polymer.

EXAMPLE 6.1

A. Preparation of a carrier

Spherical ferrite particles with an average particle diameter of 100 μm were used as the magnetic core particles. To 1000 parts by weight of the ferrite particles was added a coating agent with components as listed in Table 4, and the resultant was mimed with a thermal stirrer. The solvent was removed from the resultant mixture, and the residue was subjected to a heat treatment at a temperature of 200° C. for 1 hour to give carrier particles each having a coating layer.

B. Preparation of a developer

The toner produced in Example 5.1 and the thus obtained carrier were homogeneously mixed to give a two-component type developer having a toner concentration of 3.5 wt %.

EXAMPLE 6.2

The same procedure was repeated as in Example 6.1 except that a coating agent with components as listed in Table 4 was used, thereby preparing a developer.

EXAMPLE 6.3

The same procedure was repeated as in Example 6.1 except that a coating agent with components as listed in Table 4 was used, thereby preparing a developer.

EXAMPLE 6.4

The same procedure was repeated as in Example 6.1 except that a coating layer is not formed on a carrier particles without using any coating agent, thereby preparing a developer.

TABLE 4

Coating agents of Examples 6.1–6.4

| component | Example 6.1 | Example 6.2 | Example 6.3 | Example 6.4 |
|---|---|---|---|---|
| Resin 1 | Acryl-modified silicone | Metylphenyl silicone | Styrene-acrylic polymer | none |
| parts by weight | 2.5 | 4.8 | 3.5 | |
| Resin 2 | Metylated melamine | γ-amino-propyl-triethoxy-silane | Methylated melamine | none |
| parts by weight | 2.5 | 0.2 | 1.5 | |
| Solvent: toluene (parts by weight) | 200 | 200 | 200 | none |

EXAMPLE 7.1

A. Preparation of a binder resin

Three parts by weight of methacrylic acid, 17 parts by weight of butyl acrylate, 80 parts by weight of styrene and a polymerization initiator were dissolved in a solvent with stirring. The resultant mixture was charged in a reactor and polymerized at a temperature of 150° C. for 5 hours with stirring with an impeller. Then, the solvent was removed, and the residue was dried to give a low molecular weight polymer.

Next, 10 parts by weight of methacrylic acid, 20 parts by weight of butyl acrylate, 70 parts by weight of styrene, a polymerization initiator and 100 parts by weight of the low molecular weight polymer were dissolved in a solvent with stirring. The resultant mixture was charged in a reactor and polymerized at a temperature of 80° C. for 15 hours with stirring with an impeller. Then, the solvent was removed, and the residue was dried to give a binder resin including the low molecular weight polymer and a high molecular weight polymer.

The obtained binder resin had a peak of the molecular weight of 10,000, a weight-average molecular weight of 100,000, and an acid value of 10.

B. Preparation of toner

| Components of toner | Parts by weight |
|---|---|
| Binder resin[a)] | 100 |
| Coloring agent: Carbon black | 10 |
| Magnetic powder: Magnetite | 2 |
| Wax | 3 |

[a)]the stylene-acrylic polymer obtained in item A.

The above listed components were fused and kneaded with a biaxial extruder, and the resultant was crushed with a jet mill, and classified with a pneumatic classifier to give toner particles with an average particle diameter of 10.0 μm.

To the obtained toner particles were added 0.3 part by weight of hydrophobic silica fine powder with an average particle diameter of 0.015 μm as a fluidity enhancer and 0.6 part by weight of alumina fine particles with an average particle diameter of 0.3 μm as spacer particles, on the basis of 100 parts by weight of the toner particles. The resultant mixture was mixed with a Henschel mixer for 2 minutes to give toner.

C. Preparation of a developer

The thus produced toner was homogeneously mixed with a ferrite carrier with an average particle diameter of 100 μm to give a two-component type developer with a toner concentration of 3.5 wt %.

EXAMPLE 7.2

A. Preparation of a binder resin

One part by weight of methacrylic acid, 19 parts by weight of butyl acrylate, 80 parts by weight of styrene and a polymerization initiator were dissolved in a solvent with stirring. The resultant mixture was charged in a reactor and polymerized at a temperature of 200° C. for 3 hours with stirring with an impeller. Then, the solvent was removed, and the residue was dried to give a low molecular weight polymer.

Next, 1 part by weight of methacrylic acid, 24 parts by weight of butyl acrylate, 75 parts by weight of styrene, a polymerization initiator and 100 parts by weight of the low molecular weight polymer were dissolved in a solvent with stirring. The resultant mixture was charged in a reactor and polymerized at a temperature of 120° C. for 8 hours with stirring with an impeller. Then, the solvent was removed, and the residue was dried to give a binder resin including the low molecular weight polymer and a high molecular weight polymer.

The obtained binder resin has a peak of the molecular weight of 3,000, a weight-average molecular weight of 60,000, and an acid value of 2.

B. Preparation of toner

Toner was prepared in the same manner as in Example 7.1 except that the binder resin produced in item A was used.

C. Preparation of a developer

The thus obtained toner was homogeneously mixed with a ferrite carrier having an average particle diameter of 100 μm to give a two-component type developer with a toner concentration of 3.5 wt %.

EXAMPLE 7.3

A. Preparation of a binder resin

Fifteen parts by weight of methacrylic acid, 10 parts by weight of butyl acrylate, 75 parts by weight of styrene and a polymerization initiator were dissolved in a solvent with stirring. The resultant mixture was charged in a reactor and polymerized at a temperature of 120° C. for 7 hours with stirring with an impeller. Then, the solvent was removed, and the residue was dried to give a low molecular weight polymer.

Next, 15 parts by weight of methacrylic acid, 15 parts by weight of butyl acrylate, 70 parts by weight of styrene, a polymerization initiator and 100 parts by weight of the low molecular weight polymer were dissolved in a solvent with stirring. The resultant mixture was charged in a reactor and polymerized at a temperature of 60° C. for 20 hours with stirring with an impeller. Then, the solvent was removed, and the residue was dried to give a binder resin including the low molecular weight polymer and a high molecular weight polymer.

The obtained binder resin has a peak of the molecular weight of 35,000, a weight-average molecular weight of 250,000, and an acid value of 25.

B. Preparation of toner

Toner was prepared in the same manner as in Example 7.1 except that the binder resin produced in item A was used.

C. Preparation of a developer

The thus obtained toner was homogeneously mixed with a ferrite carrier having an average particle diameter of 100 μm to give a two-component type developer with a toner concentration of 3.5 wt %.

EXAMPLE 8.1

A. Preparation of a carrier

Spherical ferrite particles with an average particle diameter of 100 μm were used as the magnetic core particles. To 1000 parts by weight of the ferrite particles was added a coating agent with components as listed in Table 5, and the resultant was mixed with a thermal stirrer. The solvent was removed from the resultant mixture, and the residue was subjected to a heat treatment at a temperature of 200° C. for 1 hour to give carrier particles each having a coating layer.

B. Preparation of a developer

The toner produced in Example 7.1 and the thus obtained carrier were homogeneously mixed to give a two-component type developer having a toner concentration of 3.5 wt %.

EXAMPLE 8.2

The same procedure was repeated as in Example 8.1 except that a coating agent with components as listed in Table 5 was used, thereby preparing a developer.

EXAMPLE 8.3

The same procedure was repeated as in Example 8.1 except that a coating agent with components as listed in Table 5 was used, thereby preparing a developer.

EXAMPLE 8.4

The same procedure was repeated as in Example 8.1 except that a coating layer is not formed on a carrier particles without using any coating agent, thereby preparing a developer.

TABLE 5

| | Coating agents of Examples 8.1–8.4 | | | |
|---|---|---|---|---|
| component | Example 8.1 | Example 8.2 | Example 8.3 | Example 8.4 |
| Resin 1 | Acryl-modified silicone | Metylphenyl silicone | Styrene-acrylic polymer | none |
| parts by weight | 2.5 | 4.8 | 3.5 | |
| Resin 2 | Metylated melamine | γ-amino-propyl-triethoxy-silane | Methylated melamine | none |
| parts by weight | 2.5 | 0.2 | 1.5 | |
| Solvent: toluene (parts by weight) | 200 | 200 | 200 | none |

Evaluation of the developers

The developers obtained in the above described examples were evaluated with regard to the following items. An electric copying machine (manufactured by Mita Industrial Co., Ltd.; brand name: DC-4685) was modified so as to make easier evaluation sampling, and the modified copying machine was used in the evaluation.

(a) Transfer efficiency

The amount of toner in a toner hopper in the copying machine was measured at first, and a predetermined number of copies were made. Then, the amount of the toner left in the toner hopper was measured. From a difference between the amounts of the toner before and after the copying operation, a consumed amount of the toner was calculated. At the same time, the amount of the toner collected in a cleaning process during the copying operation was also measured as a collected amount. Based on these amounts, the transfer efficiency of the toner was calculated by using Equation (i) as below. An original used in the copying operation bore characters with a black area ratio of 8%. This evaluation was conducted to perform various evaluation tests described in the following items (b) through (k).

Equation (i):

$$\text{Transfer efficiency (\%)} = \frac{\text{(Consumed amount)} - \text{(Collected amount)}}{\text{(Consumed amount)}}$$

(b) Image density (I.D.)

A copying operation was continued by using an original bearing characters with a black area ratio of 8% until the transfer efficiency became less than 70%. The density of a black portion in a copied image on every 5000 copies was measured by a reflection densitometer (manufactured by Tokyo Denshoku Co., Ltd.; TC-6D), and the average density was taken as an image density (I.D.). An original used for sampling every 5000 copies had a black area ratio of 15% including a black solid portion. The results obtained from the developers of Examples 1.1 through 1.3 are listed in Table 6, those of Examples 2.1 through 2.4 in Table 7, those of Examples 3.1 through 3.3 in Table 8, those of Examples 4.1 through 4.4 in Table 9, those of Examples 5.1 through 5.3 in Table 10, those of Examples 6.1 through 6.4 in Table 11, those of Examples 7.1 through 7.3 in Table 12, and those of Examples 8.1 through 8.4 in Table 13.

(c) Fog density (F.D.)

A copying operation was continued by using an original bearing characters with a black area ratio of 8% until the transfer efficiency became less than 70%. The density of a white portion in a copied image on every 5000 copies was measured by the reflection densitometer (manufactured by Tokyo Denshotu Co., Ltd.; TC-6D). A difference between the thus measured density and the density of paper to be used for the copying operation (base paper) measured by the reflection densitometer was calculated, and the maximum difference was taken as a fog density (F.D.). An original used for sampling every 5000 copies had a black area ratio of 15% including a black solid portion. The results obtained from the developers of Examples 1.1 through 1.3 are listed in Table 6, those of Examples 2.1 through 2.4 in Table 7, those of Examples 3.1 through 3.3 in Table 8, those of Examples 4.1 through 4.4 in Table 9, those of Examples 5.1 through 5.3 in Table 10, those of Examples 6.1 through 6.4 in Table 11, those of Examples 7.1 through 7.3 in Table 12, and those of Examples 8.1 through 8.4 in Table 13.

(d) Resolution

A copying operation was conducted by using an original bearing characters with a black area ratio of 8%. When 50,000 copies were made (in the case where the transfer efficiency became less than 70% before making 50,000 copies, at that time), a normal chart original (an original bearing a plurality of patterns in each of which a predetermined number of parallel lines are drawn per 1 mm) was copied, and the obtained copied image was visually evaluated. The results obtained from the developers of Examples 1.1 through 1.3 are listed in Table 6, those of Examples 2.1 through 2.4 in Table 7, those of Examples 3.1 through 3.3 in Table 8, those of Examples 4.1 through 4.4 in Table 9, those of Examples 5.1 through 5.3 in Table 10, those of Examples 6.1 through 6.4 in Table 11, those of Examples 7.1 through 7.3 in Table 12, and those of Examples 8.1 through 8.4 in Table 13.

(e) Charge amount

A copying operation was continued by using an original bearing characters with a black area ratio of 8% until the transfer efficiency became less than 70%. During this copying operation, after making every 5,000 copies, the charge amount of 200 mg of the developer was measured by a blowoff type powder charge amount measuring device (manufactured by Toshiba Chemical Co., Ltd.), and the average of the charge amount per 1 g of the toner was calculated based on the measured value. The results obtained from the developers of Examples 1.1 through 1.3 are listed in Table 6, those of Examples 2.1 through 2.4 in Table 7, those of Examples 3.1 through 3.3 in Table 8, those of Examples 4.1 through 4.4 in Table 9, those of Examples 5.1 through 5.3 in Table 10, those of Examples 6.1 through 6.4 in Table 11, those of Examples 7.1 through 7.3 in Table 12, and those of Examples 8.1 through 8.4 in Table 13.

(f) Toner scattering

A copying operation was continued by using an original bearing characters with a black area ratio of 8% until the transfer efficiency became less than 70%. Then, the toner scattering state in the copying machine was visually observed and evaluated. The results obtained from the developers of Examples 1.1 through 1.3 are listed in Table 6, those of Examples 2.1 through 2.4 in Table 7, those of Examples 3.1 through 3.3 in Table 8, those of Examples 4.1 through 4.4 in Table 9, those of Examples 5.1 through 5.3 in Table 10, those of Examples 6.1 through 6.4 in Table 11, those of Examples 7.1 through 7.3 in Table 12, and those of Examples 8.1 through 8.4 in Table 13. In these tables, ○ indicates that the toner was not scattered; and x indicates that the toner was scattered.

(g) Durability

After making every 10,000 copies, the transfer efficiency was calculated based on the consumed amount and the collected amount of the toner to find the number of copies that had been made before the transfer efficiency became less than 70%. The number was taken as an indicator for the durability of the developer. The results obtained from the developers of Examples 1.1 through 1.3 are listed in Table 6, those of Examples 2.1 through 2.4 in Table 7, those of Examples 3.1 through 3.3 in Table 8, those of Examples 4.1 through 4.4 in Table 9, those of Examples 5.1 through 5.3 in Table 10, those of Examples 6.1 through 6.4 in Table 11, those of Examples 7.1 through 7.3 in Table 12, and those of Examples 8.1 through 8.4 in Table 13.

(h) Amount of attachment on the surface of the carrier particle due to the spent A copying operation was conducted by using an original bearing characters with a black area ratio of 8%. After making 50,000 copies (in the case where the transfer efficiency became less than 70% before making 50,000 copies, at that time), the developer was tested as follows: The developer was placed on a screen of 400 mesh, and sucked from the below with a blower, thereby separating the toner and the carrier. Five g of the carrier remained on the screen was charged in a beaker, to which toluene was added. Thus, the toner component attached onto the surfaces of the carrier particles due to the spent was dissolved. Then, the toluene solvent was discarded with the carrier attracted upon the bottom of the beaker with a magnet. This procedure was repeated several times until the resultant toluene solution became transparent. Then, the resultant carrier was heated with an oven to evaporate the toluene attached thereto, and the weight of the obtained residue was measured. A difference between the weight of the carrier charged in the beaker at first (i.e., 5 g in this case) and the weight of the residue after evaporating the toluene was taken as the amount of the toner components attached onto the surfaces of the carrier particles due to the spent (i.e., the spent amount). The spent amount is indicated as the weight in mg of the toner components attached to 1 g of the carrier. The results obtained from the developers of Examples 1.1 through 1.3 are listed in Table 6, those of Examples 2.1 through 2.4 in Table 7, those of Examples 3.1 through 3.3 in Table 8, those of Examples 4.1 through 4.4 in Table 9, those of Examples 5.1 through 5.3 in Table 10, those of Examples 6.1 through 6.4 in Table 11, those of Examples 7.1 through 7.3 in Table 12, and those of Examples 8.1 through 8.4 in Table 13.

(i) Crushability

A mixture obtained by fusing and kneading the respective components of the toner particles was supplied to a jet mill to be crushed at a predetermined pressure. At this point, a speed (g/min.) at which the mixture can be supplied to the jet mill was measured. The results are listed in Table 12, wherein ○ indicates a speed of 100 g/min. or more; and x indicates a speed of less than 100 g/min.

(j) Fixability

Transfer paper bearing a toner image of an original bearing a black solid portion was allowed to pass through fixing rollers to fix the image, and an image density (A) of the thus obtained copied image was measured. A fixability measuring device was produced by attaching a bleached cloth on the bottom of a counterbalance made of mild steel (with a diameter of 50 mm and a weight of 400 g) with an adhesive double coated tape. This fixability measuring device was allowed to slide upon the copied image between both the ends thereof five times by its own weight. Then, an image density (B) was measured. Based on the image densities (A) and (B), a fixing ratio was calculated by Equation (ii) below. The image density was measured with the reflection densitometer (manufactured by Tokyo Denshoku Co., Ltd.; TD-6D).

Equation (ii):

$$\text{Fixing Ratio (\%)} = \frac{\text{Image density (B)}}{\text{Image density (A)}} \times 100$$

The results are shown in Table 12, wherein ⊙ indicates a fixing ratio of 95% or more; ○ indicates a fixing ratio of 90% or more and less than 95%; Δ indicates a fixing ratio of 80% or more and less than 90%; and X indicates a fixing ratio of less than 80%.

(k) High temperature offset property

Figure 10:
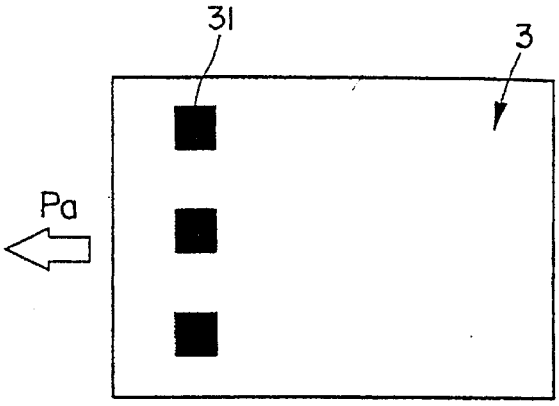
FIG. 10 is a schematic diagram of an original used in a copying performance test for observing a white dot in a black solid portion.

By using an original 3 with a size of 210 mm×297 mm bearing three black solid portions 31 each with a size of 50 mm×50 mm as is shown in FIG. 10, 500 copies were continuously made and the copied images were fixed with the heat rollers. The respective copied images were fed to the heat roller in the direction Pa as shown with a white arrow in FIG. 10. The offset phenomenon and the stain in a white portion on the 500th copied image were visually observed. The results are listed in Table 12, wherein ○ indicates that neither the offset phenomenon nor the stain was found; and X indicates that either the offset phenomenon or the stain was found.

TABLE 6

Toner component and Evaluation of Example 1.1–1.3.

| | Example 1.1 | Example 1.2 | Example 1.3 |
|---|---|---|---|
| Toner component (parts by weight) | | | |
| Binder resin | 100 | 100 | 100 |
| ;acid value | 10 | 13 | 13 |
| ;acid value ratio* | 15/5 | 15/10 | 10/15 |
| Carbon black | 10 | 10 | 10 |
| Magnetic powder | 2 | 2 | 2 |
| Charge control agent | none | none | none |
| External additive 1 (silica, 0.015 μm) | 0.3 | 0.3 | 0.3 |
| External additive 1 (almina, 0.3 μm) | 0.6 | 0.6 | 0.6 |
| Evaluation | | | |
| I.D. | 1.371 | 1.365 | 1.367 |
| F.D. | 0.002 | 0.003 | 0.003 |
| Resolution | 5 | 5 | 5 |
| Charge amount (μC/g) | −21.5 | −23.5 | −23.1 |
| Spent amount (mg) | 0.64 | 0.63 | 0.68 |
| Toner scattering | ○ | ○ | ○ |
| Durability (copies) | 90,000 | 80,000 | 60,000 |

*A high molecular weight polymer/a low molecular weight polymer

TABLE 7

| Evaluation of Examples 2.1–2.4 | | | | |
|---|---|---|---|---|
| | Example 2.1 | Example 2.2 | Example 2.3 | Example 2.4 |
| I.D. | 1.375 | 1.320 | 1.380 | 1.363 |
| F.D. | 0.003 | 0.002 | 0.003 | 0.004 |
| Resolution | 5 | 5 | 5 | 5 |
| Charge amount (μC/g) | −23.3 | −25.0 | −24.2 | −21.8 |
| Toner scattering | ○ | ○ | ○ | ○ |
| Durability (copies) | 140,000 | 140,000 | 130,000 | 70,000 |
| Spent amount (mg) at 50,000 copies | 0.32 | 0.31 | 0.35 | 0.58 |

TABLE 8

| Toner component and Evaluation of Example 3.1–3.3. | | | |
|---|---|---|---|
| | Example 3.1 | Example 3.2 | Example 3.3 |
| Toner component (parts by weight) | | | |
| Binder resin | 100 | 100 | 100 |
| ;content of stylene component (%)* | 60 | 70 | 80 |
| Carbon black | 10 | 10 | 10 |
| Magnetic powder | 2 | 2 | 2 |
| Charge control agent | none | none | none |
| External additive 1 (silica, 0.015 μm) | 0.3 | 0.3 | 0.3 |
| External additive 1 (almina, 0.3 μm) | 0.6 | 0.6 | 0.6 |
| Evaluation | | | |
| I.D. | 1.368 | 1.365 | 1.359 |
| F.D. | 0.003 | 0.003 | 0.003 |
| Resolution | 5 | 5 | 5 |
| Charge amount (μC/g) | −23.8 | −22.9 | −22.5 |
| Spent amount (mg) | 0.66 | 0.65 | 0.69 |
| Toner scattering | ○ | ○ | ○ |
| Durability (copies) | 90,000 | 80,000 | 60,000 |

*Content of a stylene component in a low molecular polymer.

TABLE 9

| Evaluation of Examples 4.1–4.4 | | | | |
|---|---|---|---|---|
| | Example 4.1 | Example 4.2 | Example 4.3 | Example 4.4 |
| I.D. | 1.383 | 1.315 | 1.383 | 1.358 |
| F.D. | 0.002 | 0.003 | 0.003 | 0.004 |
| Resolution | 5 | 5 | 5 | 5 |
| Charge amount (μC/g) | −24.0 | −25.6 | −24.7 | −22.3 |
| Toner scattering | ○ | ○ | ○ | ○ |
| Durability (copies) | 140,000 | 140,000 | 130,000 | 70,000 |
| Spent amount (mg) at 50,000 copies | 0.31 | 0.31 | 0.34 | 0.57 |

TABLE 10

| Toner component and Evaluation of Example 5.1–5.3. | | | |
|---|---|---|---|
| | Example 5.1 | Example 5.2 | Example 5.3 |
| Toner component (parts by weight) | | | |
| Binder resin | 100 | 100 | 100 |

TABLE 10-continued

| Toner component and Evaluation of Example 5.1–5.3. | | | |
|---|---|---|---|
| | Example 5.1 | Example 5.2 | Example 5.3 |
| ;SP value (high, low)* | 9.36, 9.17 | 9.23, 9.42 | 9.37, 9.40 |
| Carbon black | 10 | 10 | 10 |
| Magnetic powder | 2 | 2 | 2 |
| Charge control agent | none | none | none |
| External additive 1 (silica, 0.015 μm) | 0.3 | 0.3 | 0.3 |
| External additive 1 (almina, 0.3 μm) | 0.6 | 0.6 | 0.6 |
| Evaluation | | | |
| I.D. | 1.365 | 1.366 | 1.359 |
| F.D. | 0.002 | 0.003 | 0.003 |
| Resolution | 5 | 5 | 5 |
| Charge amount (μC/g) | −22.6 | −21.7 | −22.1 |
| Spent amount (mg) | 0.65 | 0.67 | 0.69 |
| Toner scattering | ○ | ○ | ○ |
| Durability (copies) | 90,000 | 60,000 | 60,000 |
| Crushablity | ◎ | ◎ | ○ |

*The word "high" indicates a high molecular weight polymer and "low" indicates a low molecular weight polymer.

TABLE 11

| Evaluation of Examples 6.1–6.4 | | | | |
|---|---|---|---|---|
| | Example 6.1 | Example 6.2 | Example 6.3 | Example 6.4 |
| I.D. | 1.378 | 1.323 | 1.376 | 1.360 |
| F.D. | 0.003 | 0.003 | 0.003 | 0.004 |
| Resolution | 5 | 5 | 5 | 5 |
| Charge amount (μC/g) | −23.0 | −24.7 | −24.5 | −21.3 |
| Toner scattering | ○ | ○ | ○ | ○ |
| Durability (copies) | 140,000 | 140,000 | 130,000 | 70,000 |
| Spent amount (mg) at 50,000 copies | 0.32 | 0.32 | 0.35 | 0.57 |

TABLE 12

| Toner component and Evaluation of Example 7.1–7.3. | | | |
|---|---|---|---|
| | Example 7.1 | Example 7.2 | Example 7.3 |
| Toner component (parts by weight) | | | |
| Binder resin | 100 | 100 | 100 |
| ;peak molecular weight* | 10,000 | 3,000 | 35,000 |
| ;weight-average molecular weight (Mw) | 100,000 | 60,000 | 250,000 |
| ;acid value | 10 | 2 | 25 |
| Wax | 3 | 3 | 3 |
| Carbon black | 10 | 10 | 10 |
| Magnetic powder | 2 | 2 | 2 |
| Charge control agent | none | none | none |
| External additive 1 (silica, 0.015 μm) | 0.3 | 0.3 | 0.3 |
| External additive 1 (almina, 0.3 μm) | 0.6 | 0.6 | 0.6 |
| Evaluation | | | |
| I.D. | 1.372 | 1.362 | 1.359 |
| F.D. | 0.003 | 0.004 | 0.003 |
| Resolution | 5 | 5 | 5 |
| Charge amount (μC/g) | −21.5 | −22.0 | −23.1 |
| Spent amount (mg) | 0.60 | 0.72 | 0.49 |
| Toner scattering | ○ | ○ | ○ |
| Durability (copies) | 90,000 | 30,000 | 110,000 |
| Crushablity | ○ | ○ | X |
| Fixability | ○ | ○ | X |
| High temperature offset | ○ | X | ○ |

*Peak of molecular weight of a low molecular polymer.

TABLE 13

| Evaluation of Examples 8.1–8.4 | | | | |
|---|---|---|---|---|
| | Example 8.1 | Example 8.2 | Example 8.3 | Example 8.4 |
| I.D. | 1.375 | 1.330 | 1.386 | 1.360 |
| F.D. | 0.003 | 0.003 | 0.003 | 0.004 |
| Resolution | 5 | 5 | 5 | 5 |
| Charge amount (μC/g) | −23.5 | −24.3 | −25.0 | −22.2 |
| Toner scattering | ○ | ○ | ○ | ○ |
| Durability (copies) | 140,000 | 140,000 | 140,000 | 70,000 |
| Spent amount (mg) at 50,000 copies | 0.31 | 0.32 | 0.33 | 0.59 |

Review of the evaluation

The developers produced in Examples 1.1 through 1.3 containing the binder resin including the low molecular weight polymer and the high molecular weight polymer both having an anionic group were excellently stable in the fog density, the resolution and the charge amount. Further, when these developers were used, no toner scattering was observed and a spent was scarcely caused. Moreover, the developer produced in Examples 1.1 and 1.2 containing the binder resin in which the low molecular weight polymer had a smaller acid value than the high molecular weight polymer were improved in the durability as compared with the developer produced in Example 1.3

The developers produced in Examples 2.1 through 2.4 were excellently stable in the resolution and the charge amount. Further, when these developers were used, no toner scattering was observed. The developers produced in Examples 2.1 through 2.3 containing the carrier having a coating layer had a further smaller spent amount and were improved in the durability as compared with the developer produced in Example 2.4 containing the carrier having no coating layer.

The developers produced in Examples 3.1 through 3.3 were excellently stable in the fog density, the resolution and the charge amount. Further, when these developers were used, no toner scattering was observed, and a spent was scarcely caused. Moreover, the developers produced in Examples 3.1 and 3.2 containing the binder resins in which the content of styrene in the low molecular weight polymer was 70% or less was improved in the durability as compared with the developer produced in Example 3.3.

The developers produced in Examples 4.1 through 4.4 were excellently stable in the resolution and the charge amount. Further, when these developers were used, no toner scattering was observed. Moreover, the developers produced in Examples 4.1 through 4.3 containing the carrier having a coating layer had a further smaller spent amount and was improved in the durability as compared with the developer produced in Example 4.4 containing the carrier having no coating layer.

The developers produced in Examples 5.1 through 5.3 containing the toner including the low molecular weight polymer and the high molecular weight polymer both having an anionic group were excellently stable in the fog density, the resolution and the charge amount. Further, when these developers were used, no toner scattering was observed, and a spent was scarcely caused. In addition, these developers had excellent toner crushability. Moreover, the developers produced in Examples 5.1 and 5.2 containing the binder resin in which the low molecular weight polymer had a smaller SP value than the high molecular weight polymer were improved in the crushability as compared with the developer produced in Example 5.3.

The developers produced in Examples 6.1 through 6.4 were excellently stable in the fog density, the resolution and the charge amount. Further, when these developers were used, no toner scattering was observed. The developers produced in Examples 6.1 through 6.3 containing the carrier having a coating layer had a further smaller spent amount and were improved in the durability as compared with the developer produced in Example 6.4 containing the carrier with no coating layer.

The developers produced in Examples 7.1 through 7.3 containing the toner including the styrene-acrylic polymer as a binder resin were excellently stable in the fog density, the resolution and the charge amount. Further, when these developers were used, no toner scattering was observed. In addition, these developers were excellent in the toner crushability. Moreover, the developer produced in Example 7.1 containing the styrerie-acrylic polymer having predetermined characteristics was improved in the crushability, the fixability and the high temperature offset property as compared with the developers produced in Examples 7.2 and 7.3.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. Toner for a two-component developer, comprising toner particles including a binder resin and magnetic powder dispersed in said binder resin, wherein said binder resin comprises a composition containing a resin including a low molecular weight polymer with a weight average-molecular weight of less than 100,000 and an acid value of 3 to 15 mgKOH/g and a high molecular weight polymer with a weight-average molecular weight of 100,000 or more and an acid value of 6 to 25 mgKOH/g, said polymers both having an anionic group, an acid value of the binder resin is in the range from 4 to 20 mgKOH/g, and said magnetic powder is contained in said toner particles in the range of 0.1 to 5 parts by weight per 100 parts by weight of said binder resin, and wherein the toner does not contain a charge control agent.

2. Toner for a two-component developer according to claim 1, wherein said low molecular weight polymer has a smaller acid value (mgKOH/g) than said high molecular weight polymer.

3. Toner for a two-component developer according to claim 2, wherein a ratio of the acid value of said low molecular weight polymer to that of said polymer with a higher molecular weight is in the range from 1:1:2 to 1:8.

4. Toner for a two-component developer according to claim 1, wherein said low molecular weight polymer includes a styrene component at a proportion of 70% or less.

5. Toner for a two-component developer according to claim 1, wherein a content of the anionic group in said low molecular weight polymer is smaller than that in said high molecular weight polymer, and said low molecular weight polymer has a smaller SP value than that of said high molecular weight polymer.

6. Toner for a two-component developer according to claim 1, wherein said resin including said low molecular weight polymer and said high molecular weight polymer is a styrene-acrylic polymer, and said styrene-acrylic polymer having the following chemical properties:

(a) a peak of a weight-average molecular weight of said styrene-acrylic polymer being in the range between 4,000 and 30,000;

(b) a weight-average molecular weight of said styrene-acrylic polymer being in the range between 70,000 and 200,000; and (c) an acid value of said styrene-acrylic polymer being in the range between 4 and 20 mgKOH/g.

7. Toner for a two-component developer according to claim 1, wherein said magnetic powder is contained in the range of 0.5 to 3 parts by weight per 100 parts by weight of said binder resin.

8. Toner for a two-component developer according to claim 1, wherein said toner particles have a volume-based average particle diameter of 5 through 15 μm, and spacer particles with a volume-based average particle diameter of 0.05 through 1.0 μm are attached onto surfaces of said toner particles.

* * * * *